US010471717B2

(12) United States Patent
Kobayashi

(10) Patent No.: US 10,471,717 B2
(45) Date of Patent: Nov. 12, 2019

(54) LIQUID EJECTION HEAD, RECORDING DEVICE, AND METHOD MANUFACTURING LIQUID EJECTION HEAD

(71) Applicant: KYOCERA Corporation, Kyoto-shi, Kyoto (JP)

(72) Inventor: Naoki Kobayashi, Kirishima (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 15/775,439

(22) PCT Filed: Nov. 10, 2016

(86) PCT No.: PCT/JP2016/083392
§ 371 (c)(1),
(2) Date: May 11, 2018

(87) PCT Pub. No.: WO2017/082354
PCT Pub. Date: May 18, 2017

(65) Prior Publication Data

US 2018/0354266 A1 Dec. 13, 2018

(30) Foreign Application Priority Data

Nov. 11, 2015 (JP) ..... 2015-221261

(51) Int. Cl.
*B41J 2/14* (2006.01)
*B41J 2/16* (2006.01)
*B41J 2/18* (2006.01)

(52) U.S. Cl.
CPC ..... *B41J 2/1607* (2013.01); *B41J 2/14201* (2013.01); *B41J 2/14209* (2013.01);
(Continued)

(58) Field of Classification Search
CPC ..... B41J 2/1607; B41J 2/14201; B41J 2/162; B41J 2/1626; B41J 2/1609; B41J 2/1623;
(Continued)

(56) References Cited

U.S. PATENT DOCUMENTS

2004/0130594 A1 7/2004 Watanabe et al.
2006/0209128 A1* 9/2006 Murai ..... B41J 2/161 347/54
2009/0244199 A1 10/2009 Watanabe

FOREIGN PATENT DOCUMENTS

JP 2002-160373 A 6/2002
JP 2004-114519 A 4/2004
(Continued)

*Primary Examiner* — Yaovi M Ameh
(74) *Attorney, Agent, or Firm* — Volpe and Koenig, P.C.

(57) ABSTRACT

A first channel member of a liquid ejection head includes a plurality of plates stacked through an adhesive. A first plate includes a second groove configuring the second common channel, and a plurality of first grooves which are communicated with the second groove from a wall surface of the second groove and individually configure a plurality of third individual channels. A second plate is bonded to a top surface of the first plate and configures an upper surface of the second common channel. The first plate includes an extension part which extends outward from the wall surface of the second groove between an end part position of one end of the second groove and a connection position closest to the end part position among connection positions of the plurality of first grooves with respect to the wall surface of the second groove.

20 Claims, 16 Drawing Sheets

(52) U.S. Cl.
CPC ..... *B41J 2/162* (2013.01); *B41J 2/1609* (2013.01); *B41J 2/1623* (2013.01); *B41J 2/1626* (2013.01); *B41J 2/18* (2013.01); *B41J 2002/14225* (2013.01); *B41J 2002/14419* (2013.01); *B41J 2002/14459* (2013.01); *B41J 2002/14491* (2013.01); *B41J 2202/12* (2013.01); *B41J 2202/20* (2013.01)

(58) Field of Classification Search
CPC ..... B41J 2/14209; B41J 2/18; B41J 2202/12; B41J 2202/20; B41J 2002/14491; B41J 2002/14419; B41J 2002/14225; B41J 2002/14459
See application file for complete search history.

(56) References Cited

FOREIGN PATENT DOCUMENTS

| | | | | | |
|---|---|---|---|---|---|
| JP | 2005-246946 | A | * | 9/2005 | ..... B41J 2/16 |
| JP | 2005-246946 | A | | 9/2005 | |
| JP | 2009-234096 | A | | 10/2009 | |

* cited by examiner

LIQUID EJECTION HEAD, RECORDING DEVICE, AND METHOD MANUFACTURING LIQUID EJECTION HEAD

TECHNICAL FIELD

The present disclosure relates to a liquid ejection head, a recording device, and a method for manufacturing a liquid ejection head.

BACKGROUND ART

Conventionally, as a printing head, for example there is known a liquid ejection head performing various types of printing by ejecting liquid onto a recording medium. The liquid ejection head has a channel member having channels in which liquid flows. The channel member is configured by stacking a plurality of plates through an adhesive. The channels in the channel member are configured by formation of holes (for example recessed grooves or through grooves) in a plurality of plates, and include a common channel and a plurality of ejection units connected to the common channel. Each ejection unit has an individual channel connected to the common channel, a pressurizing chamber connected to the individual channel, and an ejection hole connected to the pressurizing chamber. By pressurization of the pressurizing chamber, liquid is ejected from the ejection hole. The liquid is supplied to the pressurizing chamber from the common channel through the individual channel. Further, the liquid is sometimes circulated by recovering the liquid in the pressurizing chambers at the common channel through the individual channels.

In Patent Literature 1 and 2, a plurality of common channels are coupled with each other at their two ends. Accordingly, in the plate configuring the channel member, between each two or more through grooves which individually configure the plurality of common channels, an island-shaped portion is configured. The island-shaped portions are isolated from the rest of the portions in the plate (outer frame), so would drop out from the plates before stacking the plate. Therefore, in Patent Literature 1 and 2, provision is made of connection parts which connect the wall surfaces on the two sides of the through grooves configuring the common channels to each other and are thinner than the plate to connect the island-shaped portions to each other and connect the island-shaped portions and the outer frame and thereby prevent the island-shaped portions from dropping out.

CITATION LIST

Patent Literature

Patent Literature 1: Japanese Patent Publication No. 2004-114519A

Patent Literature 2: Japanese Patent Publication No. 2009-234096A

SUMMARY OF INVENTION

An embodiment of a liquid ejection head in the present disclosure includes a channel member and a plurality of pressurizing parts. The channel member includes a plurality of plates stacked through an adhesive. By holes formed in the plurality of plates, a common channel and a plurality of ejection units connected to the common channel are configured. Each of the plurality of ejection units includes an ejection hole, a pressurizing chamber connected to the ejection hole, and individual channels connected to the pressurizing chamber and the common channel. A plurality of pressurizing parts individually pressurize the plurality of pressurizing chambers. The plurality of plates include a first plate and second plate. The first plate includes a common channel-use groove configuring the common channel and a plurality of individual channel-use grooves which are communicated with the common channel-use groove from one wall surface between wall surfaces on the two sides of the common channel-use groove and individually configure the plurality of individual channels. The second plate is adhered to a top surface of the first plate and configures an upper surface of the common channel. The one wall surface of the common channel-use groove includes a connection region and a non-connection region along the common channel-use groove. The plurality of individual channel-use grooves are connected to the connection region. The non-connection region is adjacent to the connection region, does not have the plurality of individual channel-use grooves connected to it, and is longer than a distance between each two neighboring connection positions among connection positions of the plurality of individual channel-use grooves with respect to the one wall surface in the connection region. The first plate includes at least one extension part which extends outward from the one wall surface in the non-connection region.

An embodiment of a liquid ejection head in the present disclosure includes a channel member and a plurality of pressurizing parts. The channel member includes a plurality of plates stacked through an adhesive. By holes formed in the plurality of plates, a common channel and a plurality of ejection units connected to the common channel are configured. Each of the plurality of ejection units includes an ejection hole, a pressurizing chamber connected to the ejection hole, and individual channels connected to the pressurizing chamber and the common channel. A plurality of pressurizing parts individually pressurize the plurality of pressurizing chambers. The plurality of plates include a first plate and second plate. The first plate includes a common channel-use groove configuring the common channel and a plurality of individual channel-use grooves which are communicated with the common channel-use groove from one wall surface between wall surfaces on the two sides of the common channel-use groove and individually configure the plurality of individual channels. The second plate is adhered to a top surface of the first plate and configures an upper surface of the common channel. The one wall surface of the common channel-use groove includes a connection region and a non-connection region along the common channel-use groove. The plurality of individual channel-use grooves are connected to the connection region. The non-connection region is adjacent to the connection region, does not have the plurality of individual channel-use grooves connected to it, and is longer than a distance between each two neighboring connection positions among connection positions of the plurality of individual channel-use grooves with respect to the one wall surface in the connection region. The first plate, in the non-connection region, includes at least one dummy channel-use groove which is communicated with the common channel-use groove from the one wall surface. By the dummy channel-use groove, a dummy channel which is not connected to the plurality of ejection units is configured.

An embodiment of a recording device in the present disclosure includes the liquid ejection head described above, a conveying part conveying a recording medium with respect to the liquid ejection head, and a control part controlling the liquid ejection head.

An embodiment of a method for manufacturing the liquid ejection head in the present disclosure is a method manufacturing the liquid ejection head described above, includes a step of placing the adhesive over the entire bottom surface of the second plate and a step of superposing the bottom surface of the second plate on which the adhesive is placed on the top surface of the first plate.

DESCRIPTION OF EMBODIMENTS

First Embodiment (Overall Configuration of Printer)

Figure 1A:
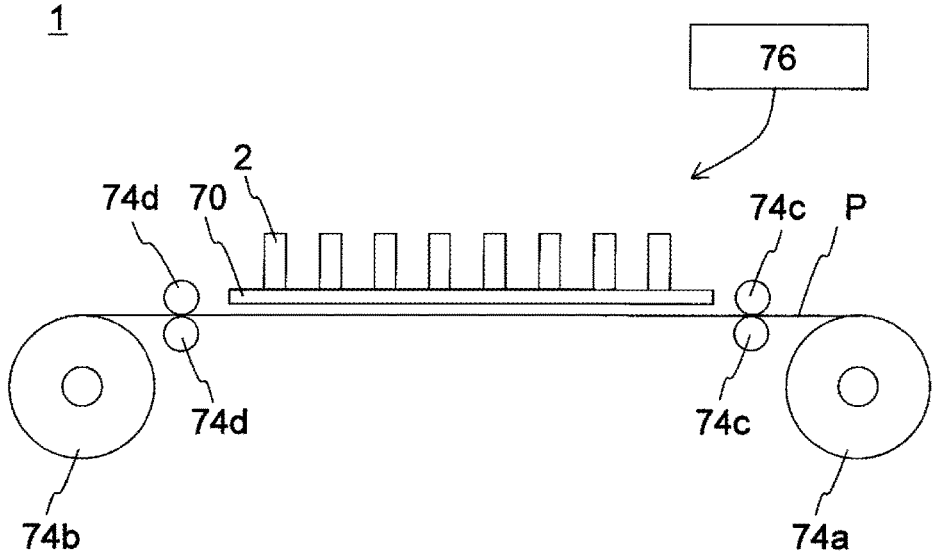
FIG. 1A is a side view schematically showing a recording device including a liquid ejection head according to a first embodiment.

Using FIG. 1, a color inkjet printer 1 (below, referred to as a "printer 1") including a liquid ejection head 2 according to a first embodiment will be explained.

The printer 1 conveys a recording medium P from a conveying roller 74*a* to a conveying roller 74*b* to make the recording medium P move relative to the liquid ejection heads 2. A control part 76 controls the liquid ejection heads 2 based on image or text data to make them eject liquid toward the recording medium P and shoot droplets onto the recording medium P to thereby perform printing on the recording medium P.

In the present embodiment, the liquid ejection heads 2 are fixed with respect to the printer 1, so the printer 1 becomes a so-called line printer. As another embodiment of the recording device, there can be mentioned a so-called serial printer. Note that, the liquid ejection head 2 may be used in any orientation relative to the vertical direction. However, in the following description, as a matter of convenience, the "upper surface" or other terms will be sometimes used by defining the upper part on the paper surface in FIG. 1 as the upper side.

To the printer 1, a plate-shaped head mounting frame 70 is fixed so that it becomes substantially parallel to the recording medium P. The head mounting frame 70 is provided with 20 holes (not shown). Twenty liquid ejection heads 2 are mounted in the holes. Five liquid ejection heads 2 configure one head group 72, and the printer 1 has four head groups 72.

Figure 1B:
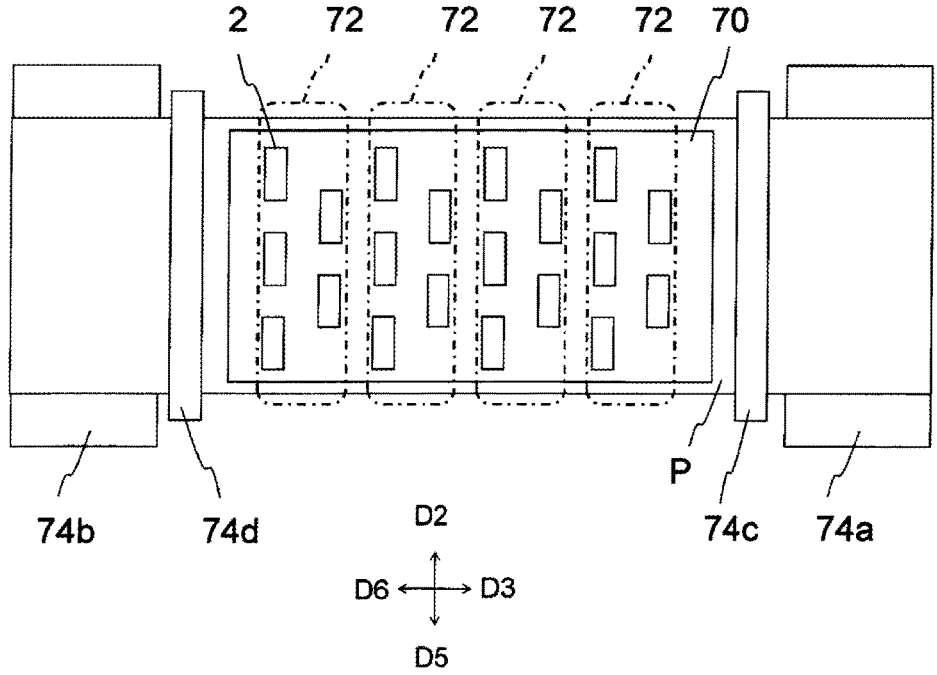
FIG. 1B is a plan view schematically showing a recording device including a liquid ejection head according to the first embodiment.

A liquid ejection head 2 has an elongated long shape as shown in FIG. 1B. In one head group 72, three liquid ejection heads 2 are aligned in a direction crossing the conveying direction of the recording medium P. The other two liquid ejection heads 2 are aligned at positions offset along the conveying direction so that each is arranged between two among the three liquid ejection heads 2. The adjacent liquid ejection heads 2 are arranged so that ranges which can be printed by the liquid ejection heads 2 are connected in the width direction of the recording medium P or the ends overlap each other, therefore printing without a gap becomes possible in the width direction of the recording medium P.

The four head groups 72 are arranged along the conveying direction of the recording medium P. To each liquid ejection head 2, ink is supplied from a not shown liquid tank. To the liquid ejection heads 2 belonging to one head group 72, ink of the same color is supplied. Inks of four colors are printed by the four head groups 72. The colors of inks ejected from the head groups 72 are for example magenta (M), yellow (Y), cyan (C), and black (K).

Note that, the number of liquid ejection heads 2 mounted in the printer 1 may be one as well so far as printing is carried out for a range which can be printed by one liquid ejection head 2 in a single color. The number of liquid ejection heads 2 included in the head group 72 or the number of head groups 72 can be suitably changed according to the target of printing or printing conditions. For example, the number of head groups 72 may be increased as well in order to perform printing by further multiple colors. Further, by arranging a plurality of head groups 72 for printing in the same color and alternately performing printing in the conveying direction, the printing speed, that is, the conveying speed, can be made faster. Further, it is also possible to raise the resolution in the width direction of the recording medium P by preparing a plurality of head groups 2 for printing in the same color and arranging them offset in a direction crossing the conveying direction.

Further, other than printing colored inks, a coating agent or other liquid may be printed as well in order to treat the surface of the recording medium P.

The printer 1 performs printing on the recording medium P. The recording medium P is in a state wound around the conveying roller 74*a*. After passing between the two conveying rollers 74*c*, it passes under the liquid ejection heads 2 mounted in the head mounting frame 70. After that, it passes between the two conveying rollers 74*d* and is finally collected by the conveying roller 74*b*.

The recording medium P may be a fabric or the like other than printing paper. Further, the printer 1 may be formed so as to convey a conveyor belt in place of the recording medium P, and the recording medium may be, other than a rolled one, a sheet, cut fabric, wood, tile, etc. which are placed on the conveyor belt as well. Further, a liquid containing conductive particles may be ejected from the liquid ejection heads 2 to print a wiring pattern etc. of an electronic apparatus as well. Furthermore, predetermined amounts of liquid chemical agents or liquids containing chemical agents may be ejected from the liquid ejection heads 2 toward a reaction vessel or the like to cause a reaction etc. and thereby prepare pharmaceutical products.

Further, a position sensor, speed sensor, temperature sensor etc. may be mounted in the printer 1 and the control part 76 may control the parts in the printer 1 in accordance with the state of each part in the printer 1 seen from the information from each sensor. In particular, if the ejection characteristics of liquid ejected from the liquid ejection heads 2 (ejection amount, ejection speed, etc.) are influenced by the outside, the driving signal for ejecting the liquid in the liquid ejection heads 2 may be changed as well in accordance with the temperatures of the liquid ejection heads 2, the temperature of the liquid in the liquid tank, and the pressure applied from the liquid in the liquid tank to the liquid ejection heads 2.

(Overall Configuration of Liquid Ejection Head)

Next, a liquid ejection head 2 according to the first embodiment will be explained by using FIG. 2 to FIG. 10. Note that, in FIGS. 5 and 6, in order to facilitate understanding of the drawings, channels etc. which are located below other and so should be drawn by broken lines are drawn by solid lines. Further, FIG. 5A shows a portion of the second channel member 6 as a see-through view, while FIG. 5B shows the entire second channel member 6 as a see-through view. Further, in FIG. 9, the conventional flow of liquid is indicated by a broken line, the flow of the liquid in the ejection unit 15 is indicated by a solid line, and the flow of the liquid supplied from the second individual channel 14 is indicated by a dashed line.

Note that, in the drawings, a first direction D1, second direction D2, third direction D3, fourth direction D4, fifth direction D5, and sixth direction D6 are shown. The first direction D1 is toward one side in the direction in which first common channels 20 and second common channels 24 extend, and the fourth direction D4 is toward the other side in the direction in which the first common channels 20 and second common channels 24 extend. The second direction D2 is toward one side in the direction in which a first integrating channel 22 and second integrating channel 26 extend, and the fifth direction D5 is toward the other side in the direction in which the first integrating channel 22 and second integrating channel 26 extend. The third direction D3 is toward one side in a direction perpendicular to the direction in which the first integrating channel 22 and second integrating channel 26 extend, and the sixth direction D6 is toward the other side in a direction perpendicular to the direction in which the first integrating channel 22 and second integrating channel 26 extend.

Figure 2:
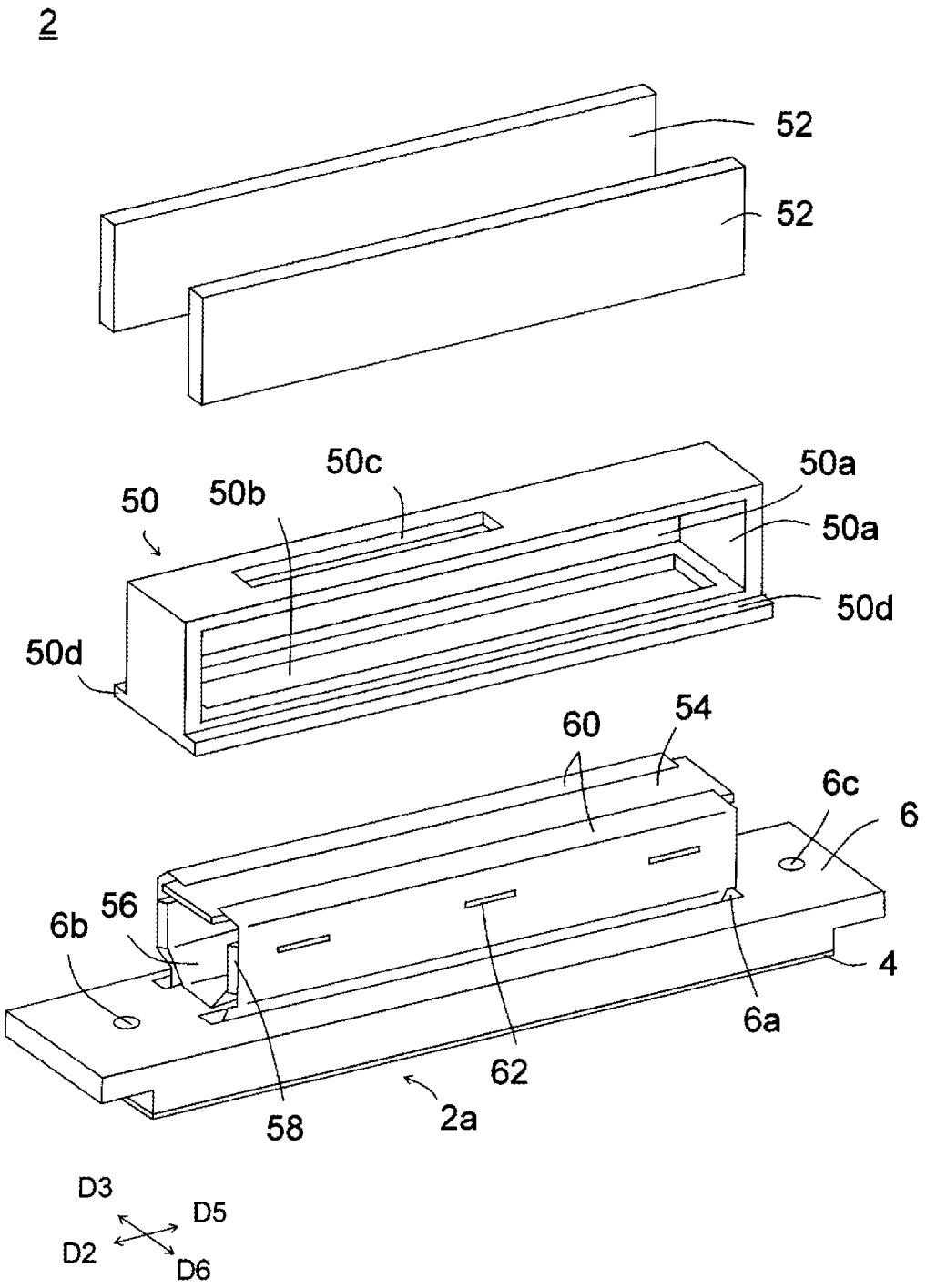
FIG. 2 A disassembled perspective view of the liquid ejection head according to the first embodiment.
Figure 3A:
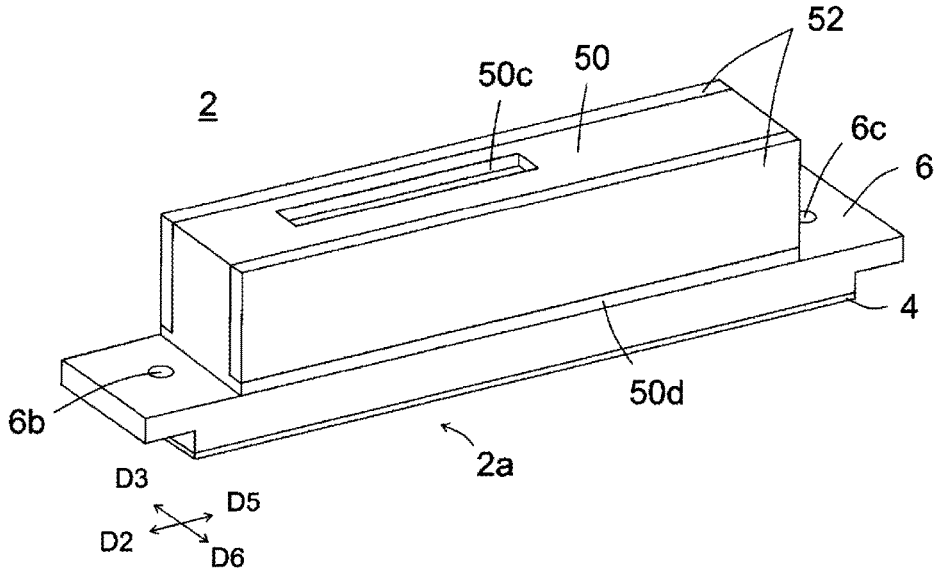
FIG. 3A is a perspective view of the liquid ejection head in FIG. 2.
Figure 3B:
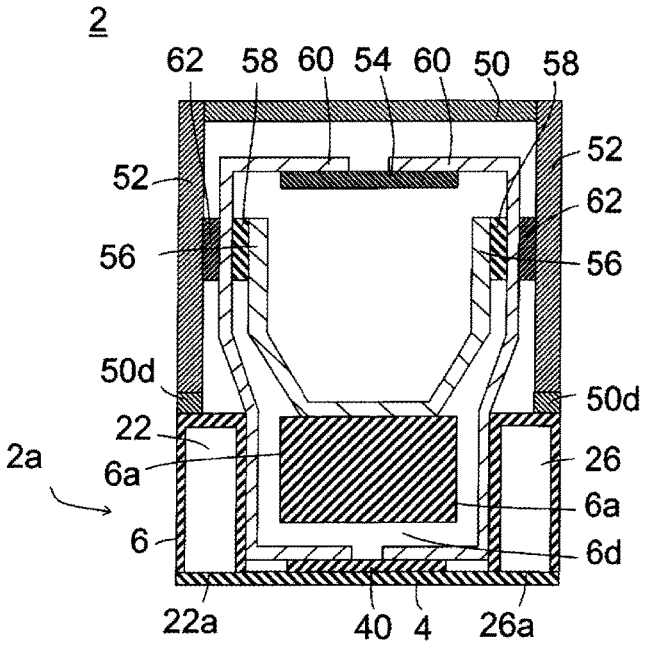
FIG. 3B is a cross-sectional view of the liquid ejection head in FIG. 2.

As shown in FIG. 2, a liquid ejection head 2 is provided with a head body 2*a*, housing 50, heat radiation plates 52, a circuit board 54, pressing member 56, elastic member 58, signal transmission parts 60, and driver ICs (Integrated Circuits) 62. Note that, the liquid ejection head 2 need only be provided with the head body 2*a*. It need not always be provided with the housing 50, heat radiation plates 52, circuit board 54, pressing member 56, elastic member 58, signal transmission parts 60, and driver ICs.

In the liquid ejection head 2, the signal transmission parts 60 are led out from the head body 2*a*. The signal transmission parts 60 are electrically connected to the circuit board 54. The signal transmission parts 60 are provided with the driver ICs 62 for controlling driving of the liquid ejection heads 2. The driver ICs 62 are pressed against the heat radiation plates 52 by the pressing member 56 through the elastic member 58. Note that, illustration of support members supporting the circuit board 54 is omitted.

The heat radiation plates 52 can be formed by a metal or alloy and are provided for radiating off heat of the driver ICs 62 to the outside. The heat radiation plates 52 are joined to the housing 50 by screws or an adhesive.

The housing 50 is placed on the head body 2*a*. The members configuring the liquid ejection head 2 are covered by the housing 50 and heat radiation plates 52. The housing 50 is provided with openings 50*a*, 50*b*, and 50*c* and heat insulation parts 50*d*. The openings 50*a* are individually provided so as to face the third direction D3 and the sixth direction D6 and have the heat radiation plates 52 arranged on them. The opening 50*b* is opened toward the bottom. The circuit board 54 and pressing member 56 are arranged inside the housing 50 through the opening 50*b*. The opening 50*c* is opened upward and accommodates inside it a connector (not shown) provided on the circuit board 54.

The heat insulation parts 50*d* are provided so as to extend from the second direction D2 to the fifth direction D5 and are arranged between the heat radiation plates 52 and the head body 2*a*. Due to this, the possibility of transfer of the heat radiated by the heat radiation plates 52 to the head body 2*a* can be reduced. The housing 50 can be formed by a metal, alloy, or plastic.

(Overall Configuration of Head Body)

Figure 4A:
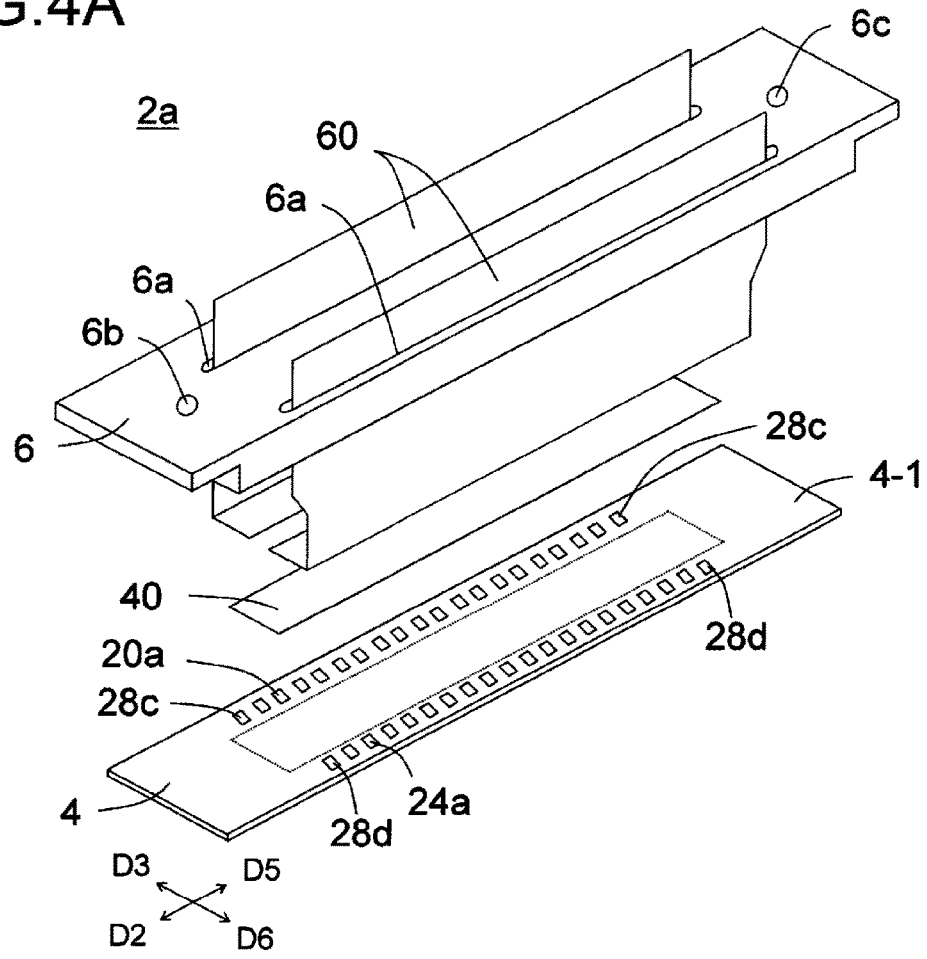
FIG. 4A is a disassembled perspective view of a head body.
Figure 5A:
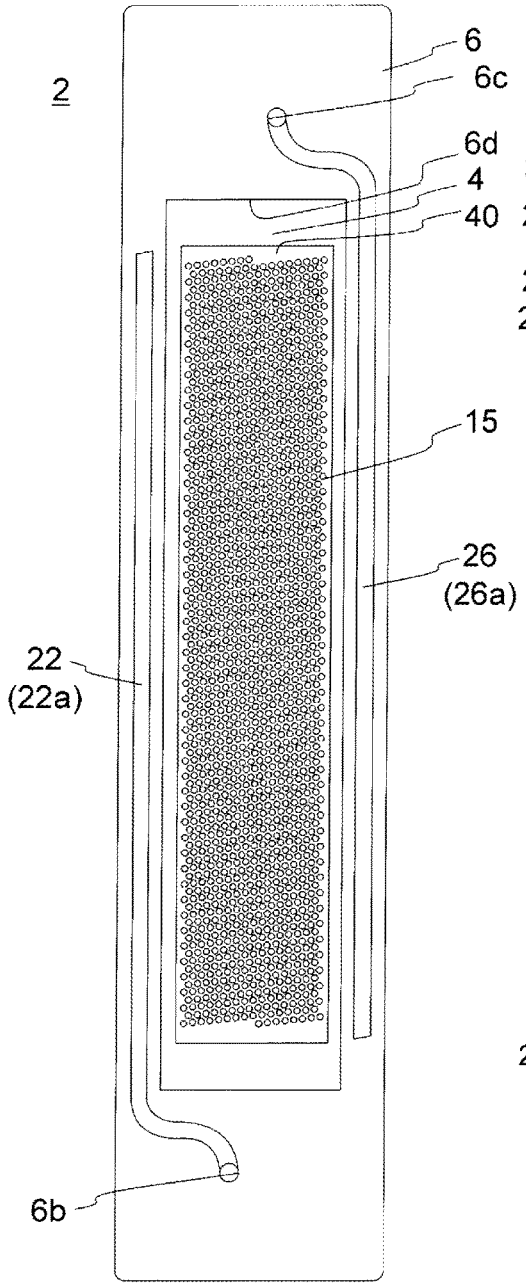
FIG. 5A is a plan view of the head body when viewed through a portion of the second channel member.
Figure 5B:
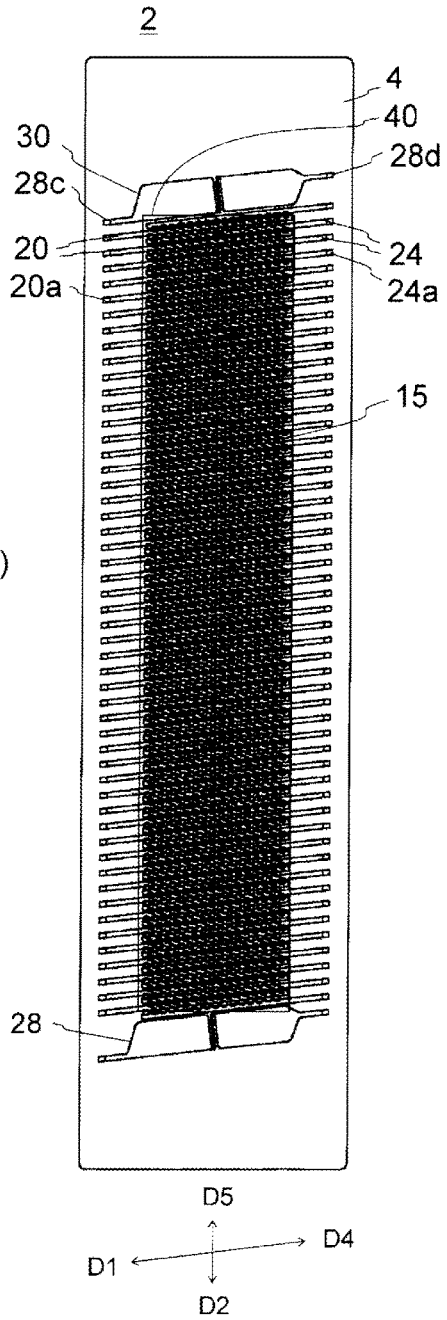
FIG. 5B is a plan view when viewed through the second channel member.

As shown in FIG. 4A, the head body 2*a* is long plate shape extending from the second direction D2 toward the fifth direction D5 and has a first channel member 4, second channel member 6, and piezoelectric actuator substrate 40. In the head body 2*a*, the piezoelectric actuator substrate 40 and second channel member 6 are provided on the first channel member 4. The piezoelectric actuator substrate 40 is placed in a region indicated by the broken line in FIG. 4A. The piezoelectric actuator substrate 40 is provided for pressurizing a plurality of pressurizing chambers 10 (see FIG. 8) provided in the first channel member 4 and has a plurality of displacement elements (see FIG. 8).

(Overall Configuration of Channel Members)

Figure 8A:
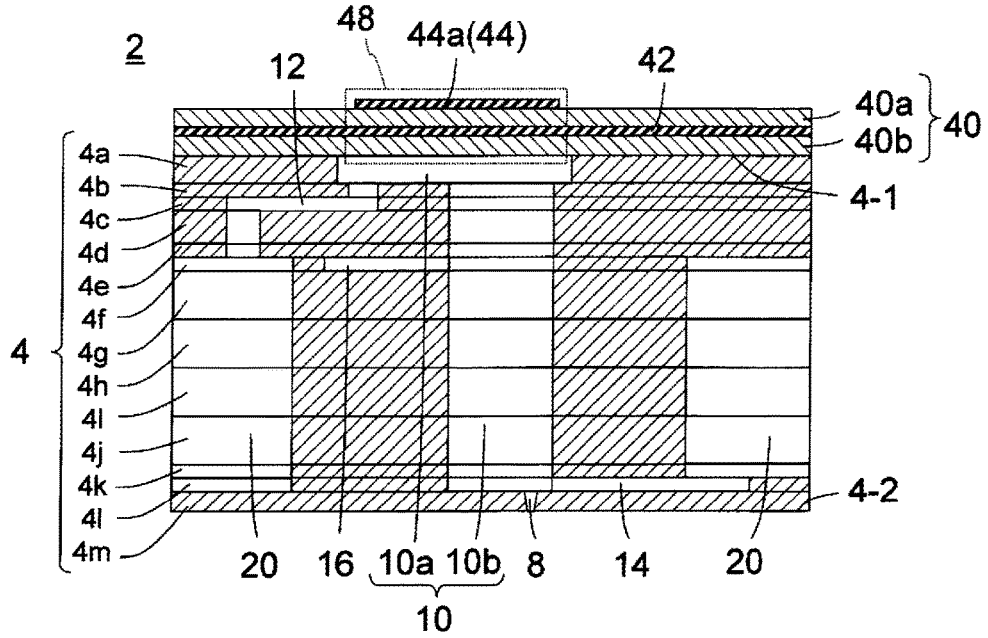
FIG. 8A is a cross-sectional view along the VIIIa-VIIIa line in FIG. 7B.
Figure 8B:
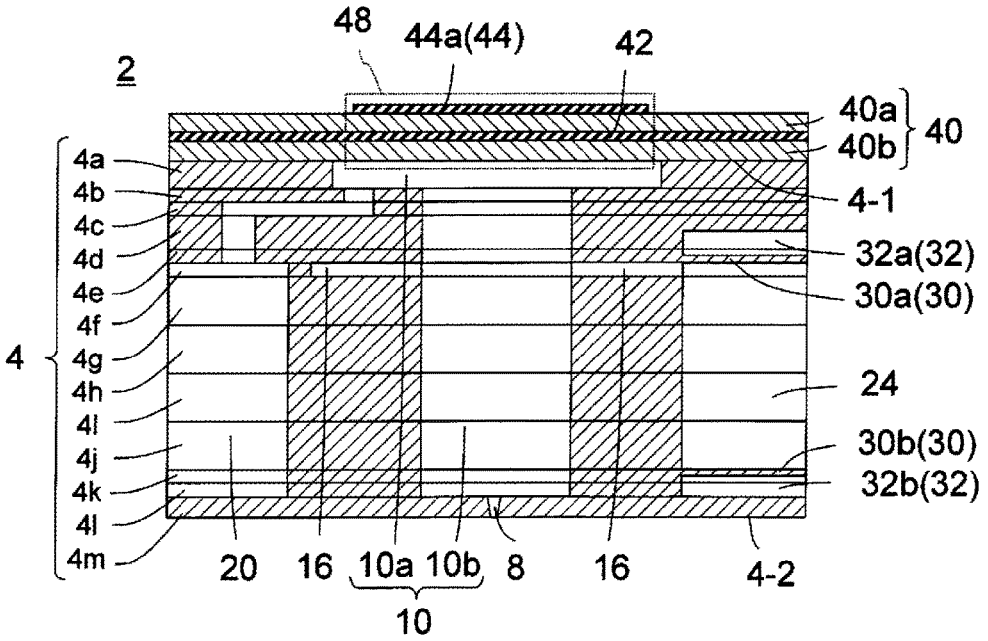
FIG. 8B is a cross-sectional view along the VIIIb-VIIIb line in FIG. 7B.

The first channel member 4 has channels formed inside it and guides the liquid supplied from the second channel member 6 up to the ejection holes 8 (see FIG. 8). In the first channel member 4, one major surface forms a pressurizing chamber surface 4-1. Openings 20*a*, 24*a*, 28*c*, and 28*d* are formed in the pressurizing chamber surface 4-1. The openings 20*a* are aligned from the second direction D2 to the fifth direction D5 and are arranged in the end part of the pressurizing chamber surface 4-1 in the third direction D3. The openings 24*a* are aligned from the second direction D2 to the fifth direction D5 and are arranged in the end part of the pressurizing chamber surface 4-1 in the sixth direction D6. The openings 28*c* are provided on the outer side in the second direction D2 and fifth direction D5 from the openings 20*a*. The openings 28*d* are provided on the outer side in the second direction D2 and fifth direction D5 from the openings 24*a*.

The second channel member 6 has channels formed inside it and guides the liquid supplied from the liquid tank to the first channel member 4. The second channel member 6 is provided on the peripheral portion of the pressurizing chamber surface 4-1 of the first channel member 4 and is joined to the first channel member 4 through an adhesive (not shown) outside of the region for placing the piezoelectric actuator substrate 40.

(Second Channel Member (Integrating Channels))

Figure 4B:
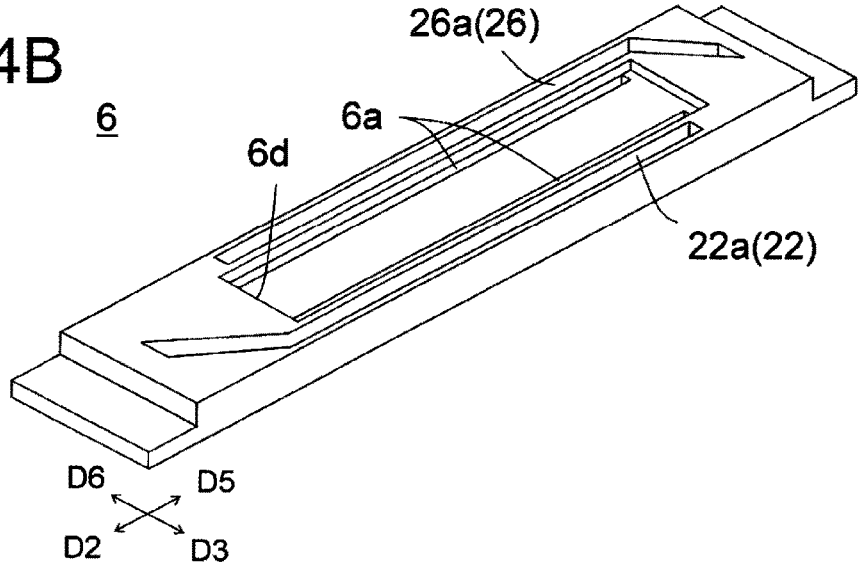
FIG. 4B is a perspective view when viewed from a lower surface of a second channel member.

In the second channel member 6, as shown in FIGS. 4 and 5, through holes 6*a* and openings 6*b*, 6*c*, 6*d*, 22*a*, and 26*a* are formed. The through holes 6*a* are formed so as to extend from the second direction D2 to the fifth direction D5 and are arranged on the outer sides from the region for placing the piezoelectric actuator substrate 40. The signal transmission parts 60 are inserted in the through holes 6*a*.

The opening 6*b* is provided in the upper surface of the second channel member 6 and is arranged in the end part of the second channel member 6 in the second direction D2. The opening 6*b* supplies the liquid from the liquid tank to the second channel member 6. The opening 6*c* is provided in the upper surface of the second channel member 6 and is arranged in the end part of the second channel member in the fifth direction D5. The opening 6*c* recovers the liquid from the second channel member 6 for return to the liquid tank. The opening 6*d* is provided in the lower surface of the second channel member 6. The piezoelectric actuator substrate 40 is arranged in a space formed by the opening 6*d*.

The opening 22*a* is provided in the lower surface of the second channel member 6 and is provided so as to extend from the second direction D2 toward the fifth direction D5. The opening 22*a* is formed in the end part of the second channel member 6 in the third direction D3 and is provided closer to the third direction D3 side than the through hole 6*a*.

The opening 22*a* is communicated with the opening 6*b*. The first integrating channel 22 is formed by sealing the opening 22*a* by the first channel member 4. The first integrating channel 22 is formed so as to extend from the second direction D2 to the fifth direction D5 and supplies liquid to the openings 20*a* and openings 28*c* in the first channel member 4.

The opening 26*a* is provided in the lower surface of the second channel member 6 and is provided so as to extend from the fifth direction D5 toward the second direction D2. The opening 26*a* is formed in the end part of the second channel member 6 in the sixth direction D6 and is provided closer to the sixth direction D6 side than the through hole 6*a*.

The opening 26*a* is communicated with the opening 6*c*. The second integrating channel 26 is formed by sealing the opening 26*a* by the first channel member 4. The second integrating channel 26 is formed so as to extend from the second direction D2 to the fifth direction D5 and recovers the liquid from the openings 24*a* and openings 28*d* in the first channel member 4.

From the above configuration, in the second channel member 6, the liquid supplied from the liquid tank to the opening 6*b* is supplied to the first integrating channel 22 and flows through the opening 22*a* into the first common channels 20, thereby the liquid is supplied to the first channel member 4. Then, the liquid recovered by the second common channels 24 flows through the opening 26*a* into the second integrating channel 26, then the liquid is recovered at the outside through the opening 6*c*. Note that, the second channel member 6 need not always be provided.

(First Channel Member (Common Channels and Ejection Units))

As shown in FIGS. 5 to 8, the first channel member 4 is formed by stacking a plurality of plates 4*a* to 4*m* and has a pressurizing chamber surface 4-1 and ejection hole surface 4-2. On the pressurizing chamber surface 4-1, the piezoelectric actuator substrate 40 is placed. The liquid is ejected from ejection holes 8 opened in the ejection hole surface 4-2. The plurality of plates 4*a* to 4*m* can be formed by a metal, alloy, or plastic.

In the first channel member 4, a plurality of first common channels 20, plurality of second common channels 24, plurality of end part channels 28, plurality of ejection units 15, and plurality of dummy ejection units 17 are formed. The openings 20*a* and 24*a* are formed in the pressurizing chamber surface 4-1.

The first common channels 20 are provided so as to extend from the first direction D1 to the fourth direction D4 and are formed so as to communicate with the openings 20*a*. Further, the plurality of first common channels 20 are aligned from the second direction D2 toward the fifth direction D5.

The second common channels 24 are provided so as to extend from the fourth direction D4 to the first direction D1 and are formed so as to communicate with the openings 24*a*. Further, the plurality of second common channels 24 are aligned from the second direction D2 toward the fifth direction D5. Each is arranged between each two first common channels 20 adjacent to each other. For this reason, the first common channels 20 and the second common channels 24 are alternately arranged from the second direction D2 toward the fifth direction D5.

In the first channel member 4, damper chambers 32 (FIG. 8B) are provided so as to face the second common channels 24. That is, the damper chambers 32 are arranged so as to face the second common channels 24 through dampers 30. The dampers 30 include a first damper 30*a* and second damper 30*b*. The damper chambers 32 include a first damper chamber 32*a* and second damper chamber 32*b*. The first damper chamber 32*a* is provided over the second common channels 24 through the first damper 30*a*. The second damper chamber 32*b* is provided under the second common channels 24 through the second damper 30*b*. By providing dampers 30 in this way, pressure waves entering into the second common channels 24 can be attenuated.

The end part channel 28 is formed in the end part of the first channel member 4 in the second direction D2 and end part in the fifth direction D5. The end part channel 28 has broad-width portions 28*a*, a narrowed portion 28*b*, and openings 28*c* and 28*d*. The liquid supplied from the opening 28*c* flows through the broad-width portion 28*a*, narrowed portion 28*b*, broad width portion 28*a*, and opening 28*d* in that order to thereby flow through the end part channel 28. Due to that, the liquid becomes present in the end part channel 28 while the liquid flows through the end part channel 28, therefore the temperature of the end part channel 28 is made uniform by the liquid. Therefore, in the first channel member 4, the possibility of heat radiation from the end part in the second direction D2 and the end part in the fifth direction D5 is reduced. Further, by arranging the end part channel 28 in the end part in the second direction D2, the flow rate near the opening 24*a* positioned on the end part in the second direction D2 becomes faster in the second integrating channel 26, therefore precipitation of pigment etc. contained in the liquid can be suppressed. In the same way, by arranging the end part channel 28 in the end part in the fifth direction D5, the flow rate near the opening 20*a* positioned on the end part in the second direction D2 becomes faster in the first integrating channel 22, therefore precipitation of pigment etc. contained in the liquid can be suppressed.

(Shape of Ejection Unit)

Figure 7A:
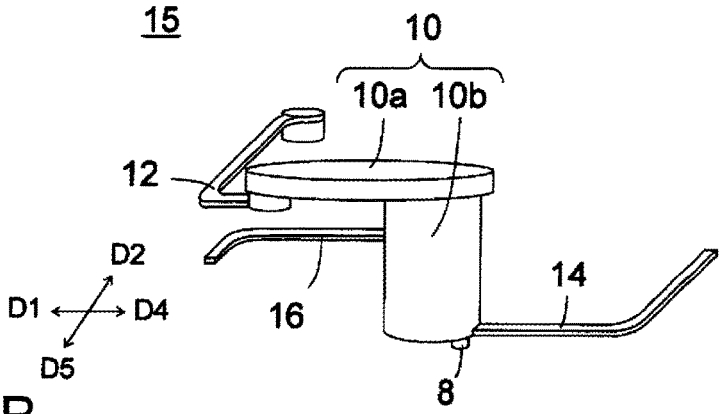
FIG. 7A is a perspective view of an ejection unit.
Figure 7B:
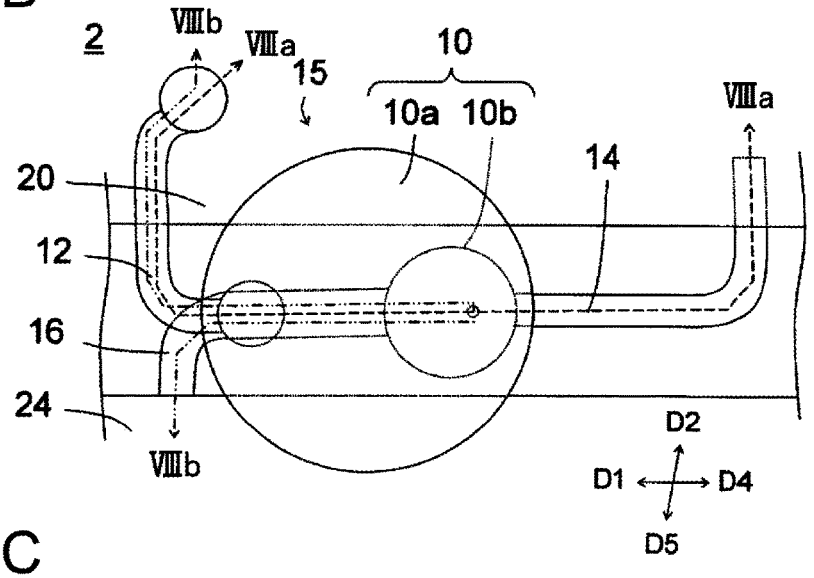
FIG. 7B is a plan view of the ejection unit.

Each ejection unit 15, as shown in FIG. 7A, has an ejection hole 8, pressurizing chamber 10, first individual channel 12, second individual channel 14, and third individual channel 16. The ejection units 15 are provided between first common channels 20 and second common channels 24 which are adjacent to each other and form a matrix in a surface direction of the first channel member 4. The ejection units 15 form ejection unit columns 15*a* and ejection unit rows 15*b*. The ejection unit columns 15*a* are aligned from the first direction D1 toward the fourth direction D4. The ejection unit rows 15*b* are aligned from the second direction D2 toward the fifth direction D5.

Further, the pressurizing chambers 10 form pressurizing chamber columns 10*c* and pressurizing chamber rows 10*d*. Ejection hole columns 8*a* and pressurizing chamber columns 10*c* are aligned from the first direction D1 toward the fourth direction D4 in the same way. Further, ejection hole rows 8*b* and pressurizing chamber rows 10*d* are aligned from the second direction D2 toward the fifth direction D5 in the same way. Note that, each ejection hole row 8*b* is configured by ejection holes 8 which are connected with the pressurizing chambers 10 belonging to two pressurizing chamber rows 10*d*.

The angle formed by the first direction D1 and the fourth direction D4 and the second direction D2 and fifth direction D5 is off from a right angle. For this reason, the ejection holes 8 belonging to the ejection hole columns 8*a* which are arranged along the first direction D1 are arranged offset in the second direction D2 by the amount of the angle off from the right angle. Further, the ejection hole columns 8*a* are arranged aligned in the second direction D2, therefore the ejection holes 8 belonging to the different ejection hole columns 8*a* are arranged offset in the second direction D2 by that amount. By combining them, the ejection holes 8 in the first channel member 4 are aligned at constant intervals in the second direction D2. Due to this, printing can be carried out so as to fill a predetermined range with pixels formed by the ejected liquid.

Figure 6:
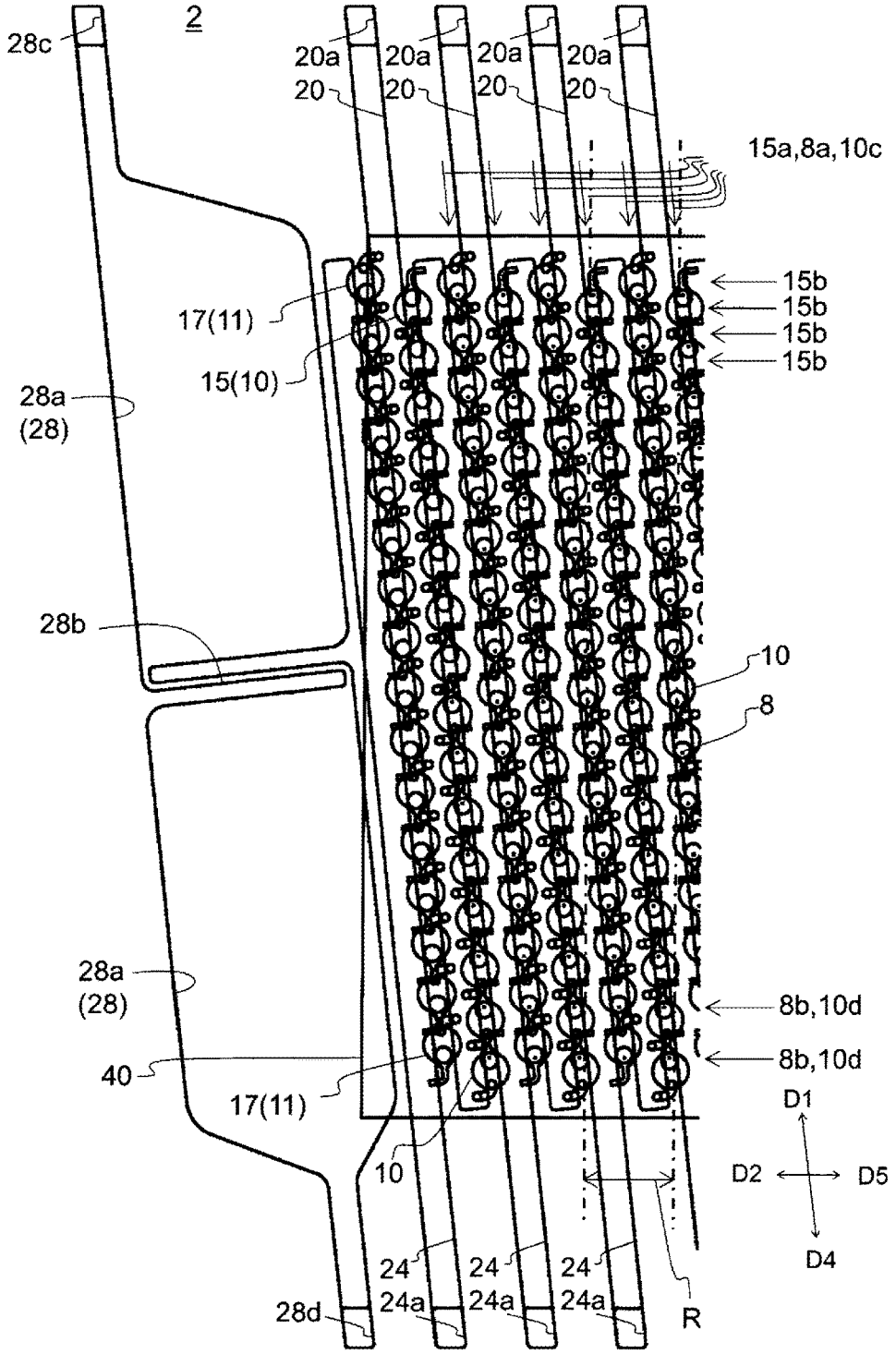
FIG. 6 A plan view showing a portion in FIGS. 5A and 5B enlarged.

In FIG. 6, when projecting the ejection holes 8 to the third direction D3 and sixth direction D6, 32 ejection holes 8 are projected in a range of the imaginary lines R, therefore the ejection holes 8 are aligned at intervals of 360 dpi on the imaginary lines R. Due to this, if the recording medium P is conveyed in the direction perpendicular to the imaginary lines R to perform printing, printing can be carried out with a resolution of 360 dpi.

The dummy ejection units 17 (dummy pressurizing chambers 11) are provided between the first common channel 20 positioned nearest the second direction D2 side and the second common channel 24 positioned nearest the second direction D2 side. Further, the dummy ejection units 17 are also provided between the first common channel 20 positioned nearest the fifth direction D5 side and the second common channel 24 positioned nearest the fifth direction D5 side. The dummy ejection units 17 are provided so as to stabilize the ejection of the ejection unit column 15*a* which is positioned nearest the second direction D2 or fifth direction D5 side.

Each ejection unit 15, as shown in FIG. 7A, has an ejection hole 8, pressurizing chamber 10, first individual channel 12, second individual channel 14, and third individual channel 16. In the liquid ejection head 2, the liquid is supplied from the first individual channel 12 and second individual channel 14 to the pressurizing chamber 10. The third individual channel 16 recovers the liquid from the pressurizing chamber 10.

The pressurizing chamber 10 has a pressurizing chamber body 10*a* and partial channel 10*b*. The pressurizing chamber body 10*a* is circular shaped when viewed on a plane. The partial channel 10*b* extends from the center of the pressurizing chamber body 10*a* toward the bottom. The pressurizing chamber body 10*a* is configured so as to apply pressure to the liquid in the partial channel 10*b* by receiving pressure from the displacement element 48 provided on the pressurizing chamber body 10*a*.

The pressurizing chamber body 10*a* is a right circular cylinder shape and has a circular planar shape. By the planar shape being circular, the amount of displacement and the change of volume of the pressurizing chamber 10 caused by displacement can be made larger. The partial channel 10*b* is a right circular cylinder shape having a smaller diameter than the pressurizing chamber body 10*a* and has a circular planar shape. Further, the partial channel 10*b* is arranged at a position where it falls in the pressurizing chamber body 10*a* when viewed from the pressurizing chamber surface 4-1.

Note that, the partial channel 10*b* may be a cone shape or conical frustum shape where the cross-sectional area becomes smaller toward the ejection hole 8 side as well. Due to that, the widths of the first common channel 20 and second common channel 24 can be made larger, therefore the supply and discharge of the liquid can be stabilized.

The pressurizing chambers 10 are aligned along the two sides of each of the first common channels 20 and configure one column on each side, i.e., two pressurizing chamber columns 10*c* in total. The first common channels 20 and the pressurizing chambers 10 which are aligned on the two sides thereof are connected through the first individual channels 12 and second individual channels 14.

Further, the pressurizing chambers 10 are aligned along the two sides of each of the second common channels 24 and configure one column on each side, i.e., two pressurizing chamber columns 10*c* in total. The second common channels 24 and the pressurizing chambers 10 which are aligned on the two sides thereof are connected through the third individual channels 16.

A first individual channel 12 connects a first common channel 20 and a pressurizing chamber body 10*a*. The first individual channel 12 extends upward from the upper surface of the first common channel 20, then extends toward the fifth direction D5, extends toward the fourth direction D4, and then extends upward again and is connected to the bottom surface of the pressurizing chamber body 10*a*.

A second individual channel 14 connects a first common channel 20 and a partial channel 10*b*. The second individual channel 14 extends from the lower surface of the first common channel 20 toward the fifth direction D5, extends toward the first direction D1, and then is connected to the side surface of the partial channel 10*b*.

A third individual channel 16 connects a second common channel 24 and a partial channel 10*b*. The third individual channel 16 extends from the side surface of the second common channel 24 toward the second direction D2, extends toward the fourth direction D4, and then is connected to the side surface of the partial channel 10*b*. The channel resistance of the third individual channel 16 is made smaller than the channel resistance of the second individual channel 14.

According to the configuration described above, in the first channel member 4, the liquid supplied through the openings 20*a* to the first common channels 20 flows into the pressurizing chambers 10 through the first individual channels 12 and second individual channels 14. Part of the liquid is ejected from the ejection holes 8. Further, the remaining liquid flows from the pressurizing chambers 10 into the second common channels 24 through the third individual channels 16 and is discharged from the first channel member 4 to the second channel member 6 through the openings 24*a*.

(Piezoelectric Actuator)

The piezoelectric actuator substrate 40 including the displacement elements 48 is joined to the top surface of the first channel member 4. It is arranged so that the displacement elements 48 are positioned over the pressurizing chambers 10. The piezoelectric actuator substrate 40 occupies a region having substantially the same shape as that of the pressurizing chamber group formed by the pressurizing chambers 10. Further, the openings of the pressurizing chambers 10 are closed by the piezoelectric actuator substrate 40 being joined to the pressurizing chamber surface 4-1 of the first channel member 4.

The piezoelectric actuator substrate 40 has a multilayer structure configured by two piezoelectric ceramic layers 40*a* and 40*b* which are piezoelectric bodies. Each of these piezoelectric ceramic layers 40*a* and 40*b* has a thickness of about 20 μm. Both of the piezoelectric ceramic layers 40*a* and 40*b* extend across the plurality of pressurizing chambers 10.

These piezoelectric ceramic layers 40*a* and 40*b* are made of for example a lead zirconate titanate (PZT)-based, $NaNbO_3$-based, $BaTiO_3$-based, $(BiNa)NbO_3$-based, $BiNaNb_5O_{15}$-based, or other ceramic material having ferroelectricity. Note that, the piezoelectric ceramic layer 40*b* acts as a vibration plate and does not always have to be a piezoelectric substance. Another ceramic layer or metal plate which is not a piezoelectric substance may be used in place of it.

On the piezoelectric actuator substrate 40, a common electrode 42, individual electrodes 44, and connection electrodes 46 are formed. The common electrode 42 is formed over almost the entire surface of the surface direction in a region between the piezoelectric ceramic layer 40*a* and the piezoelectric ceramic layer 40*b*. Further, the individual electrodes 44 are arranged at the positions facing the pressurizing chambers 10 on the upper surface of the piezoelectric actuator substrate 40.

The parts of the piezoelectric ceramic layer 40*a* which are sandwiched between the individual electrodes 44 and the common electrode 42 form unimorph structure displacement elements 48 which are polarized in the thickness direction and displace when voltage is applied to the individual electrodes 44. For this reason, the piezoelectric actuator substrate 40 has a plurality of displacement elements 48.

The common electrode 42 can be formed by an Ag—Pd-based metal material or the like. The thickness of the common electrode 42 can be made about 2 μm. The common electrode 42 has a common electrode-use surface electrode (not shown) on the piezoelectric ceramic layer 40*a*. The common electrode-use surface electrode is connected with the common electrode 42 through a via hole formed penetrating through the piezoelectric ceramic layer 40*a*, is grounded, and is held at a ground potential.

Figure 7C:
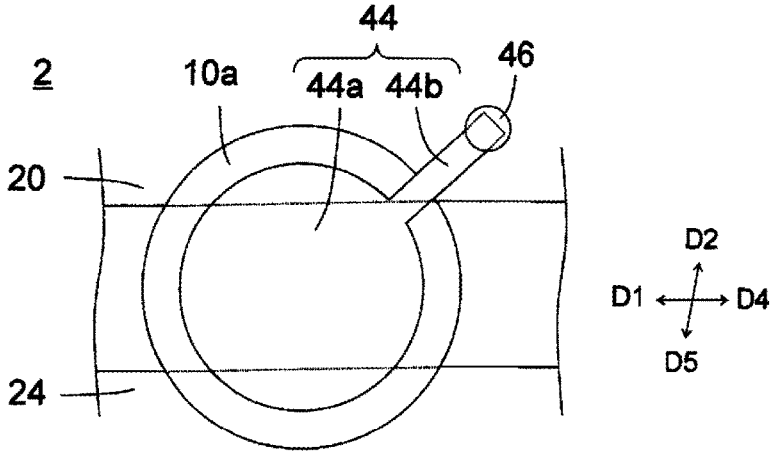
FIG. 7C is a plan view showing an electrode on the ejection unit.

An individual electrode 44 is formed by an Au-based metal material or other material and has an individual electrode body 44*a* and led out electrode 44*b*. As shown in FIG. 7C, the individual electrode body 44*a* is formed in an almost circular shape when viewed on a plane and is formed smaller than the pressurizing chamber body 10*a*. The led out electrode 44*b* is led out from the individual electrode body 44*a*. A connection electrode 46 is formed on the led out led out electrode 44*b*.

The connection electrode 46 is made of for example silver-palladium containing glass frit and is formed so as to project out with a thickness of about 15 μm. The connection electrode 46 is electrically joined with an electrode provided in the signal transmission part 60.

(Ejection Operation)

Next, the ejection operation of the liquid will be explained. Under control from the control part 76, the displacement elements 48 displace by driving signals supplied to the individual electrodes 44 through the driver ICs 62 etc. As the driving method, use can be made of so-called pull-push driving.

An ejection unit 15 in the liquid ejection head 2 will be explained in detail by using FIGS. 9 and 10. Note that, in FIG. 9, the actual flow of liquid is indicated by the solid lines, the conventional flow of liquid is indicated by the broken line, and the flow of the liquid supplied from the second individual channel 14 is indicated by the dashed line.

The ejection unit 15 is provided with an ejection hole 8, pressurizing chamber 10, first individual channel 12, second individual channel 14, and third individual channel 16. The first individual channel 12 and the second individual channel 14 are connected to the first common channel 20 (see FIG. 8), while the third individual channel 16 is connected to the second common channel 24. For this reason, the ejection unit 15 is supplied with the liquid from the first individual channel 12 and second individual channel 14. The liquid which is not ejected is recovered by the third individual channel 16.

The first individual channel 12 is connected on the first direction D1 side of the pressurizing chamber body 10*a*. The second individual channel 14 is connected on the fourth direction D4 side of the partial channel 10*b*. The third individual channel 16 is connected on the first direction D1 side of the partial channel 10*b*.

The liquid supplied from the first individual channel 12 passes through the pressurizing chamber body 10*a* and flows downward in the partial channel 10*b*. Part of this is ejected from the ejection hole 8. The liquid which is not ejected from the ejection hole 8 is recovered at the outside of the ejection unit 15 through the third individual channel 16.

Part of the liquid supplied from the second individual channel 14 is ejected from the ejection hole 8. The liquid which is not ejected from the ejection hole 8 flows upward in the partial channel 10*b* and is recovered at the outside of the ejection unit 15 through the third individual channel 16.

Figure 9:
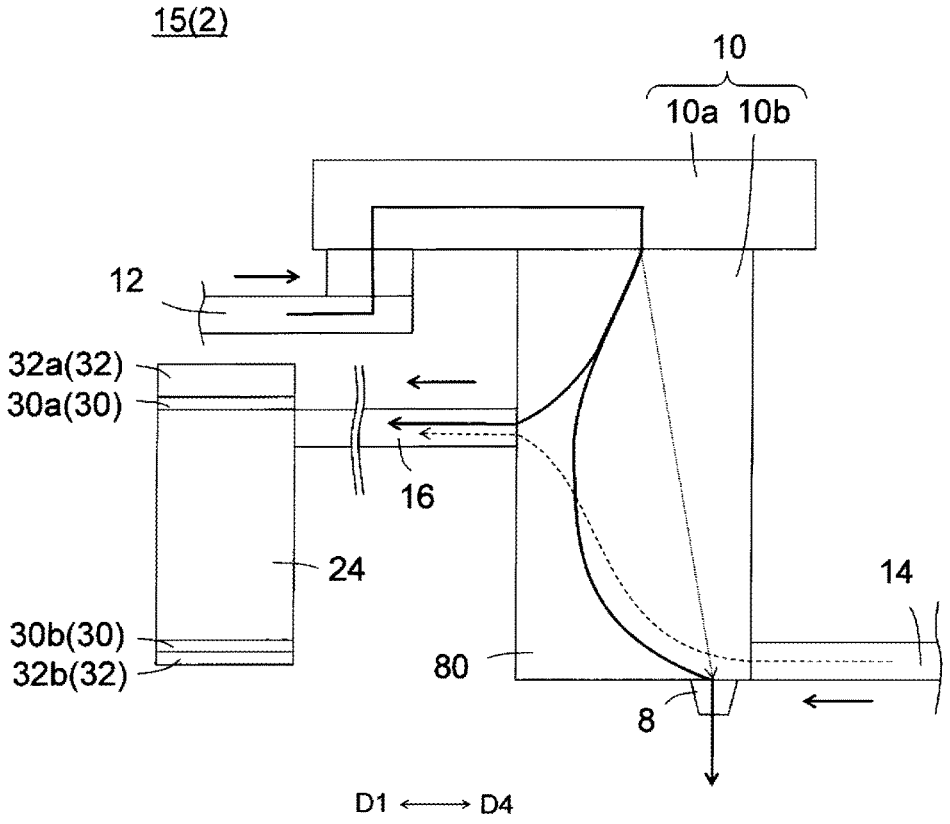
FIG. 9 A conceptual view showing a flow of a fluid inside the liquid ejection unit.

Here, as shown in FIG. 9, the liquid supplied from the first individual channel 12 flows through the pressurizing chamber body 10*a* and partial channel 10*b* and is ejected from the ejection hole 8. As indicated by the broken line, the flow of the liquid in the conventional ejection unit uniformly flows in a substantially linear state from the central part of the pressurizing chamber body 10*a* toward the ejection hole 8.

When such a flow is generated, in the partial channel 10*b*, an area 80 and its periphery positioned on the opposite side from the outlet of the second individual channel 14 are configured to be hard for the liquid to flow through. Therefore, for example, there is a possibility of generation of a region in which the liquid pools near the area 80.

Contrary to this, in the first channel member 4, the first individual channel 12 and second individual channel 14 for supplying liquid are connected to the positions of the pressurizing chamber 10 which are different from each other. Specifically, for example, the first individual channel 12 is connected to the pressurizing chamber body 10*a*, while the second individual channel 14 is connected to the partial channel 10*b*.

For this reason, the flow of the liquid supplied from the second individual channel 14 to the partial channel 10*b* can be made to strike the flow of the liquid which is supplied from the pressurizing chamber body 10*a* to the ejection hole 8. Due to that, the liquid which is supplied from the pressurizing chamber body 10*a* to the ejection hole 8 can be kept from uniformly and substantially linearly flowing, therefore the possibility of generation of a region where the liquid pools in the partial channel 10*b* can be reduced.

That is, the position of the point where the liquid pools, which is generated by the flow of the liquid supplied from the pressurizing chamber body 10*a* to the ejection hole 8, moves due to collision of the flow of the liquid supplied from the pressurizing chamber body 10*a* to the ejection hole 8, therefore the possibility of generation of a region where the liquid pools in the partial channel 10*b* can be reduced.

Further, the third individual channel 16 for recovery of liquid is connected to the pressurizing chamber 10. Specifically, for example, the third individual channel 16 is connected to the partial channel 10*b*. For this reason, the flow of the liquid from the second individual channel 14 toward the third individual channel 16 transverses the internal portion of the partial channel 10*b*. As a result, the liquid which flows from the second individual channel 14 toward the third individual channel 16 can be made to flow so as to transverse the flow of the liquid supplied from the pressurizing chamber body 10*a* to the ejection hole 8. Therefore, the possibility of generation of a region where the liquid pools in the partial channel 10*b* can be further reduced.

Note that, the third individual channel 16 may be connected to the pressurizing chamber body 10*a* as well. In this case as well, the flow of the liquid supplied from the second individual channel 14 can be made to strike the flow of the liquid supplied from the pressurizing chamber body 10*a* to the ejection hole 8.

(Detailed Shape and Action of Individual Channels etc.)

Further, the third individual channel 16 is connected to the partial channel 10*b* and is connected closer to the pressurizing chamber body 10*a* side than the second individual channel 14. For this reason, even in a case where air bubbles intrude to the internal portion of the partial channel 10*b* from the ejection hole 8, air bubbles can be discharged to the third individual channel 16 by utilizing the buoyancy of the air bubbles. Due to that, the possibility of air bubbles remaining in the partial channel 10*b* and thereby exerting an influence upon the propagation of pressure to the liquid can be reduced.

Further, the second individual channel 14 is connected to the ejection hole 8 side of the partial channel 10*b*. Due to that, the flow rate of the liquid in the vicinity of the ejection hole 8 can be made faster, therefore the possibility of precipitation of pigment etc. contained in the liquid and clogging in the ejection hole 8 can be reduced.

Further, when viewed on a plane, the first individual channel 12 is connected on the first direction D1 side of the pressurizing chamber body 10*a*, while the second individual channel 14 is connected on the fourth direction D4 side of the partial channel 10*b*.

For this reason, when viewed on a plane, the liquid ends up being supplied to the ejection unit 15 from two sides of the first direction D1 and fourth direction D4. For this reason, the supplied liquid has a velocity component of the first direction D1 and velocity component of the fourth direction D4. Therefore, the liquid supplied to the pressurizing chamber 10 will agitate the liquid inside the partial channel 10*b*. As a result, the possibility of generation of a region where the liquid pools in the partial channel 10*b* can be further reduced.

Further, the third individual channel 16 is connected on the first direction D1 side of the partial channel 10*b*, while the ejection hole 8 is arranged on the fourth direction D4 side of the partial channel 10*b*. Due to that, the liquid can be made flow also to the first direction D1 side of the partial channel 10*b*, therefore the possibility of generation of a region where the liquid pools inside the partial channel 10*b* can be reduced.

Note that, the head may be configured so that the third individual channel 16 is connected on the fourth direction D4 side of the partial channel 10*b*, while the ejection hole 8 is arranged on the first direction D1 side of the partial channel 10*b* as well. In that case as well, the same effects can be exerted.

Further, as shown in FIG. 8, the third individual channel 16 is connected on the pressurizing chamber body 10*a* side of the second common channel 24. Due to that, the air bubbles discharged from the partial channel 10*b* can be made to flow along the upper surface of the second common channel 24. Due to that, the air bubbles can be easily discharged to the outside from the second common channel 24 through the opening 24*a* (see FIG. 6).

Further, the top surface of the third individual channel 16 and the top surface of the second common channel 24 are for example flush. Due to that, the air bubbles discharged from the partial channel 10*b* will flow along the top surface of the third individual channel 16 and the top surface of the second common channel 24, therefore they can be discharged to the outside further easily.

Further, when viewed on a plane, the first individual channel 12 is connected to the first direction D1 side of the pressurizing chamber body 10*a*, while the center of gravity of the area of the partial channel 10*b* is positioned closer to the fourth direction D4 side than the center of gravity of the area of the pressurizing chamber body 10*a*. That is, the partial channel 10*b* is connected in the pressurizing chamber body 10*a* on the side far away from the first individual channel 12.

Due to that, the liquid supplied to the first direction D1 side of the pressurizing chamber body 10*a* expands over the entire area of the pressurizing chamber body 10*a* and then is supplied to the partial channel 10*b*. As a result, the possibility of generation of a region where the liquid pools inside the pressurizing chamber body 10*a* can be reduced.

Further, when viewed on a plane, the ejection hole 8 is arranged between the second individual channel 14 and the third individual channel 16. Due to that, at the time of ejection of liquid from the ejection hole 8, the position at which the flow of the liquid supplied from the pressurizing chamber body 10*a* to the ejection hole 8 and the flow of the liquid supplied from the second individual channel 14 strike each other can be moved.

That is, the amount of ejection of liquid from the ejection hole 8 will differ according to the image printed. Along with increase or decrease of the amount of ejection of liquid, the behavior of the liquid inside the partial channel 10*b* changes. For this reason, according to the increase or decrease of the amount of ejection of liquid, the position at which the flow of the liquid supplied from the pressurizing chamber body 10*a* to the ejection hole 8 and the flow of the liquid supplied from the second individual channel 14 strike each other moves, therefore the possibility of formation of a region where the liquid pools inside the partial channel 10*b* can be reduced.

Further, the center of gravity of area of the ejection hole 8 is positioned closer to the fourth direction D4 side than the center of gravity of area of the partial channel 10*b*. Due to that, the liquid supplied to the partial channel 10*b* expands over the entire area of the partial channel 10*b* and is then supplied to the ejection hole 8, therefore the possibility of generation of a region where the liquid pools inside the partial channel 10*b* can be reduced.

Here, when the pressurizing chamber 10 is pressurized, the liquid ejection head 2 ejects the liquid from the ejection hole 8 by the pressure wave being transferred from the pressurizing chamber body 10*a* to the ejection hole 8. For this reason, there is a possibility of propagation of pressure to the first common channel 20 by part of the pressure wave generated in the pressurizing chamber body 10*a* being transferred to the second individual channel 14. In the same way, there is a possibility of propagation of pressure to the second common channel 24 by part of the pressure wave generated in the pressurizing chamber body 10*a* being transferred to the third individual channel 16.

Further, if pressure is propagated to the first common channel 20 and second common channel 24, there is a possibility of propagation of pressure to a pressurizing chamber 10 in another ejection unit 15 through the second individual channel 14 and third individual channel 16 connected to the other ejection unit 15. Due to that, there is a possibility of fluid crosstalk.

Contrary to this, the liquid ejection head 2 is configured so that the channel resistance of the third individual channel 16 is lower than the channel resistance of the second individual channel 14. Therefore, when a pressure is applied to the pressurizing chamber 10, part of the pressure wave generated in the pressurizing chamber body 10*a* becomes easier to be propagated to the second common channel 24 through the third individual channel 16 having a lower channel resistance than the second individual channel 1, therefore a configuration resistant to propagation of pressure to the first common channel 20 is obtained.

Further, the first damper chamber 32*a* is arranged above the second common channels 24, and the second damper chamber 32*b* is arranged below the beneath of the second common channels 24, therefore the first damper 30*a* is formed above the second common channels 24, and the second damper 30*b* is formed below the second common channels 24.

Due to that, pressure can be attenuated inside the second common channel 24. As a result, backflow of pressure from the second common channel 24 to the third individual channel 16 can be suppressed, therefore the possibility of crosstalk can be reduced.

Further, the third individual channel 16 is connected to the side surface of the second common channel 24 in the second direction D2. In other words, the third individual channel 16 is led out from the side surface of the second common channel 24 in the second direction D2 to the second direction D2 and then is led out to the fourth direction D4, and is connected to the side surface of the partial channel 10*b* in the first direction D1.

Therefore, the third individual channel 16 can be led out to the surface direction, therefore space for providing the damper chambers 32 above and below the second common channels 24 can be secured. As a result, the pressure can be efficiently attenuated in the second common channels 24.

Figure 10:
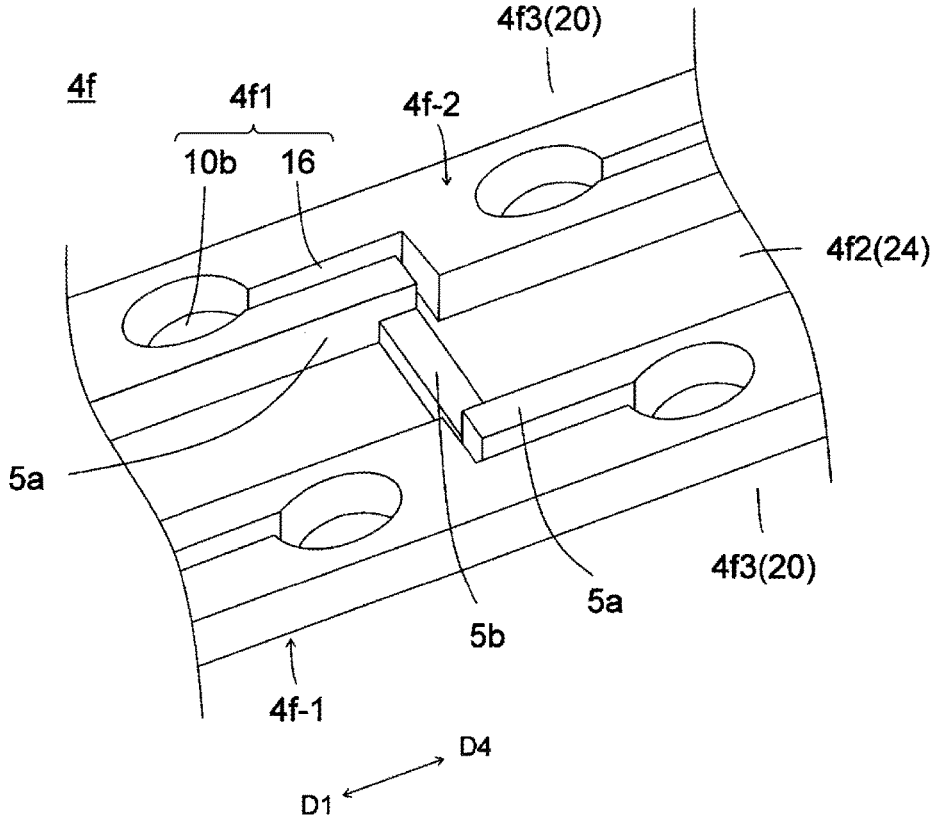
FIG. 10 A perspective view showing a portion of a plate forming the first channel member enlarged.

The third individual channel 16, as shown in FIG. 10, is formed by a plate 4*f*. The plate 4*f* has a first surface 4*f*-1 on the pressurizing chamber surface 4-1 side and a second surface 4*f*-2 on the ejection hole surface 4-2 side. Further, the plate 4*f* has a first groove 4*f*1 forming the third individual channel 16, a second groove 4*f*2 forming the second common channel 24, and a third groove 4*f*3 forming the first common channel 20. Further, between the first groove 4*f*1 and the second groove 4*f*2, partition walls 5*a* are provided. The partition walls 5*a* are provided for each ejection unit 15 in order to partition the first groove 4*f*1 and the second groove 4*f*2. The plate 4*f* has a connection part 5*b* for connecting the partition walls 5*a* facing while sandwiching the second common channel 24 between them to each other.

The first groove 4*f*1 penetrates through the plate 4*f* and forms the partial channel 10*b* and the third individual channel 16. For this reason, the first grooves 4*f*1 are formed in a matrix in the plate 4*f*. The second groove 4*f*2 penetrates through the plate 4*f* and forms the second common channel 24.

The plate 4*f* has the connection parts 5*b* connecting the partition walls 5*a* which face each other while sandwiching the second common channel 24 therebetween. For this reason, the rigidity of the partition walls 5*a* can be raised, therefore a possibility of deformation caused in the partition walls 5*a* can be reduced. As a result, the shape of the first groove 4*f*1 can be stabilized, and a possibility of occurrence of variation in shapes of the third individual channels 16 in the ejection units 15 can be reduced. Therefore, ejection variation in the ejection units 15 can be reduced. Note that, the partition walls 5*a* are not island-shaped portions which are isolated from the other portions. Therefore, unlike Patent Literature 1 and 2, the connection parts 5*b* are not indispensable configurations in the plate 4*f*.

Further, the thickness of the connection parts 5*b* is for example smaller than the thickness of the plate 4*f*. Due to that, a reduction of volume of the second common channel 24 can be suppressed. As a result, a increase of channel resistance of the second common channel 24 can be suppressed. Note that, the connection parts 5*b* can be formed by half etching (not limited to etching of half of thickness) from the second surface 4*f*-2.

Further, the third individual channel 16 is connected to the upper end part side of the second common channel 24, and the capacity of the first damper chamber 32*a* is larger than the capacity of the second damper chamber 32*b*. For this reason, the pressure wave propagated from the third individual channel 16 can be attenuated in the first damper 30*a*.

(Method for Manufacturing Liquid Ejection Head)

Figure 11:
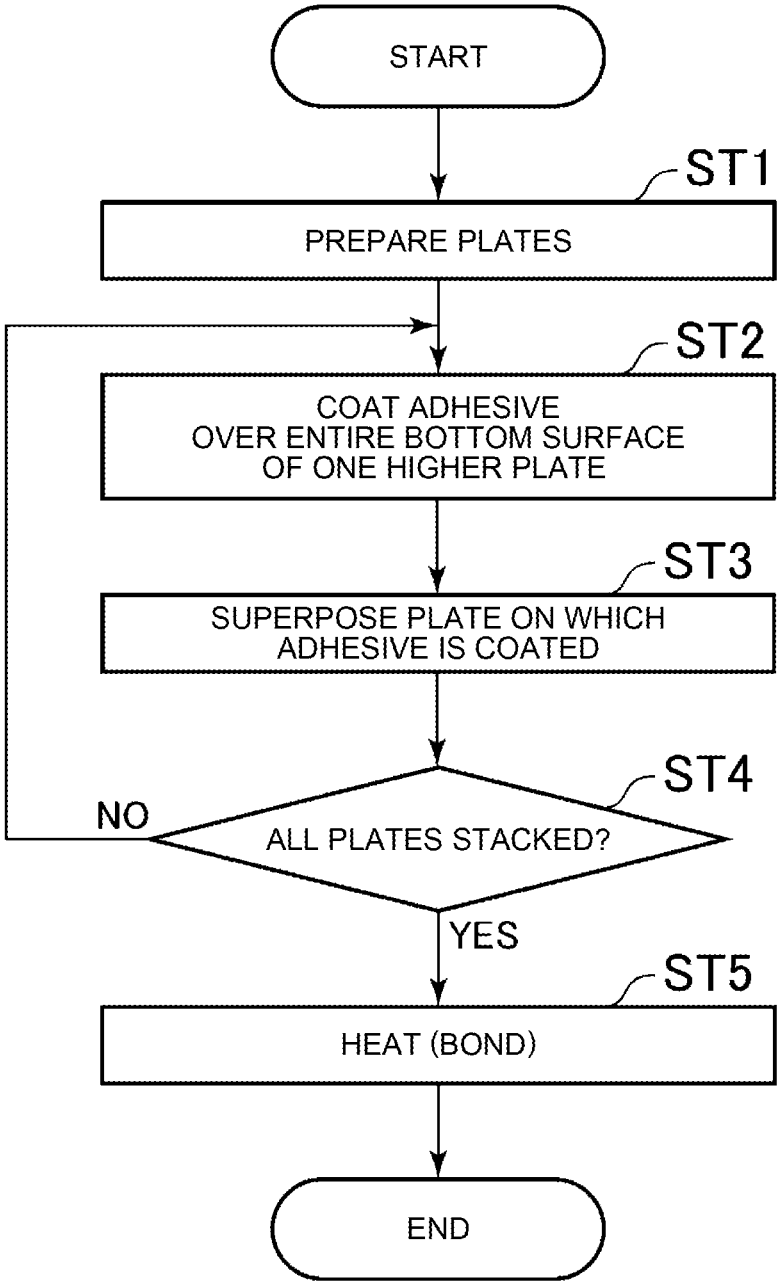
FIG. 11 A flow chart showing an example of a procedure of a method for manufacturing the first channel member.

FIG. 11 is a diagram for explaining a method for manufacturing the liquid ejection head 2. More specifically, it is a flow chart showing an example of the procedure of the method for manufacturing the first channel member 4. Note that, this manufacturing method may be basically the same as the known method except for the specific shape of the channels etc.

First, at step ST1, plates 4*a* to 4*m* are prepared. The plates 4*a* to 4*m* are for example formed by etching (including half etching) plate-shaped members made of metal etc.

At steps ST2 to ST4, the plates 4*a* to 4*m* are stacked in order from the ejection holes 8 side. Specifically, first, at step ST2, an adhesive is coated on the bottom surface of the plate which is to be superposed on the top surface of the stack of plates which have been superposed up to then (only the plate 4*m* at first). Note that, the adhesive is for example coated over the entire bottom surface of the plate. However, the adhesive may be coated by patterning as well. When patterning it, for example, the possibility of clogging of the channels due to the adhesive can be reduced. When coating it over the entire surface, for example, the quality of patterning does not affect leakage of the liquid, therefore the quality is stabilized.

Next, at step ST3, the bottom surface of the plate coated with the adhesive is superposed on the top surface of the stack. At step ST4, it is judged whether all of the plates 4*a* to 4*m* are stacked. The processing routine proceeds to step ST5 if yes and returns to step ST2 if no.

In this way, a stack in which the plates 4*a* to 4*m* are superposed through the adhesive (adhesive layers) is configured. The adhesive is for example a thermosetting resin. The thermosetting resin is for example a phenol resin, epoxy resin, melamine resin, or urea resin.

At step ST5, the stack configured by the plates 4*a* to 4*m* superposed through the adhesive made of a thermosetting resin is heated to cure the thermosetting resin. Due to this, the plates 4*a* to 4*m* are adhered to each other, therefore the first channel member 4 is prepared.

Note that, it is also possible to divide the plates 4*a* to 4*m* into several parts to form a plurality of stacks, then adhere those stacks with each other, perform the heating at step ST5 at the point of time when several plates are superposed on each other, etc. Suitable modifications are possible.

Figure 12A:
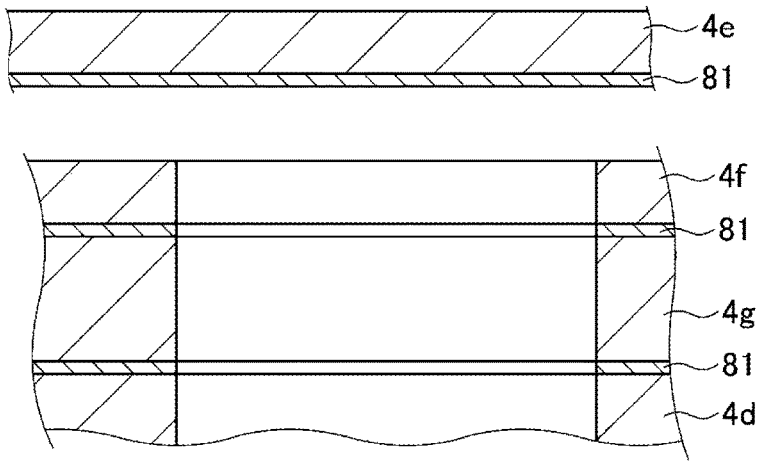
FIG. 12A to FIG. 12C are cross-sectional views or a plan view of plates in a manufacturing process of the first channel member.
Figure 12B:
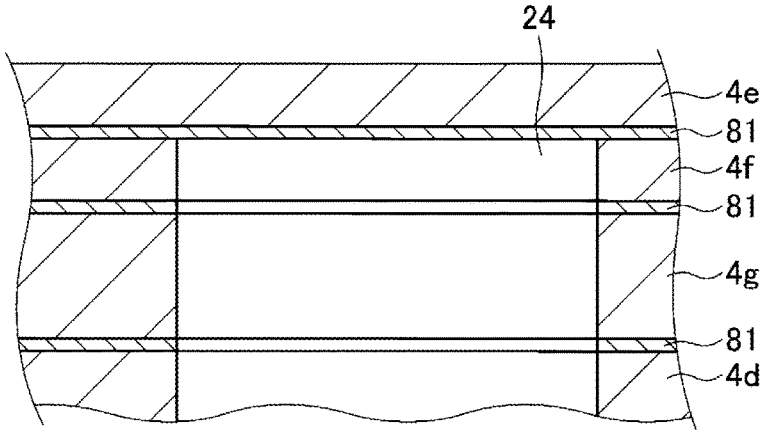

FIG. 12A and FIG. 12B schematically show the cross-sections of the plurality of plates at steps ST2 and ST3. More specifically, these figures show the step of superposing the bottom surface of the plate 4*e* on the top surface of the stack formed by the plates 4*f* to 4*m*.

As will be understood from the adhesive 81 applied to the bottom surface of the plate 4*e*, in the coating step of the adhesive 81 (step ST2), the adhesive 81 is coated not only on the region for adhering the plates to each other, but also over the entire bottom surface of each plate. For example, on the plate 4*e*, the adhesive 81 is coated also on the regions configuring the upper surfaces of the second common channels 24. By using such a coating method, for example, the same coating method can be uniformly used irrespective of the shapes of the plates (holes configuring the channels), therefore the production cost can be reduced. Note that, the adhesive is applied to the upper surfaces of the second common channels 24, but, although not particularly shown, the adhesive is not applied to the lower surfaces of the second common channels 24. This is true also for the upper surfaces and lower surfaces of the other channels.

(Clogging of Individual Channels)

Figure 12C:
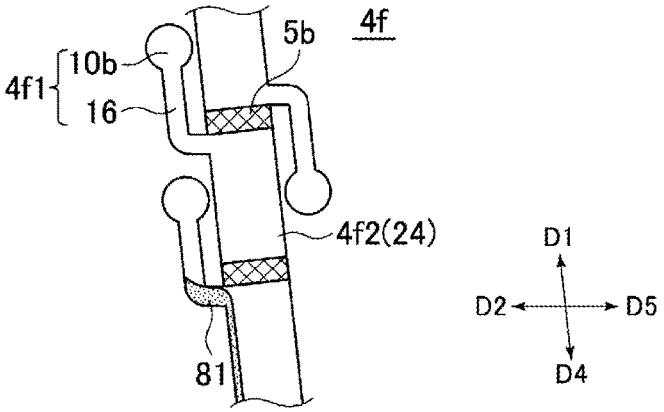

FIG. 12C is a schematic view for explaining a problem occurring in a third individual channel 16. Specifically, it is a plan view showing a portion of the plate 4*f*. In the figure, the connection parts 5*b* are cross-hatched. Further, the three first grooves 4*f*1 in the figure are positioned closest to the fourth direction D4 side.

As indicated by pattern of dots in the same figure, there is a possibility of the adhesive 81 flowing down the inner surface of the channel of the first channel member 4 before hardening and closing the individual channel having a relatively small cross-sectional area. Note that, a phenomenon of the adhesive 81 flowing in this way is for example apt to occur after the adhesive 81 is softened after the start of heating and before hardening in a case where the adhesive 81 is made of a thermosetting resin. As the force causing the flow, there can be considered gravity, the capillary force in edge portions formed by the upper surface and side surfaces of the channel, and so on.

Portions which are easy to clog are the first to third individual channels having relatively small cross-sectional areas. Among them, the third individual channel 16 most easily clogs. The reason for this is for example as follows. First, as explained above, the adhesive 81 is applied to the upper surfaces of the channels. A common channel has a broader width compared with the individual channels, therefore a relatively large amount of the adhesive 81 is applied to its upper surface. Further, the adhesive 81 on the upper surfaces of the channels is apt to flow down the edge portions formed by the upper surfaces and the side surfaces of the channels due to gravity and/or capillary force. On the other hand, the third individual channel 16 is communicated with the second common channel 24 through the side surfaces (wall surfaces) of the second common channel 24, and the upper surface of the third individual channel 16 is flush with respect to the upper surface of the second common channel 24. Accordingly, the relatively large amount of adhesive 81 which flowed down the edge portions at the wall surfaces and upper surface of the second common channel 24 easily flows into the third individual channel 16 and consequently the third individual channel 16 easily clogs.

In the plurality of ejection units 15 (plurality of third individual channels 16) in each ejection unit column 15*a*, the ejection unit 15 (third individual channel 16) connected to the second common channel 24 on the side closest to the end part of the second common channel 24 (for example opening 24*a* side) is apt to clog. As the reason for this, for example there can be mentioned the fact that the section (see the non-connection section 91 in FIG. 13) between the connection position P2 on the endmost part among the connection positions of the second common channel 24 and the plurality of third individual channels 16 and the end part of the second common channel 24 is longer in length than the pitch of the plurality of connection positions (constant in the present embodiment, but need not be constant either). That is, in the non-connection section 91, there is a larger amount of adhesive 81 than that of each section between each two among the plurality of connection positions, therefore this relatively large amount of adhesive 81 flows into the third individual channel 16 connected on the endmost part side.

Note that, the reason for the non-connection section 91 becoming longer is that it is necessary to lengthen the second common channel 24 in order to provide an opening 24*a* at a position where there is no piezoelectric actuator substrate 40 in which displacement elements 48 corresponding to the ejection units 15 are assembled. Further, it is that the first channel member 4 and the second channel member 6 are joined at the periphery of the openings 24*a*, so an extra margin for joining them is provided on the periphery of the openings 24*a*.

Note that, in the present embodiment, the distance between the end part on the opening 24*a* side (fourth direction D4) between the two ends of the second common channel 24 and the connection position P2 of the third individual channel 16 with respect to the second common channel 24 which is closest to the end part (length of the non-connection section 91) is longer than the pitch of connection positions of the plurality of third individual channels 16 with respect to the second common channel 24, therefore the problem as described above occurs. The distance between the end part (closed end part) on the side opposite from the opening 24*a* between the two ends of the second common channel 24 and the connection position P2 of the third individual channel 16 with respect to the second common channel 24 which is closest to this end part may be longer than, equal to, or shorter than the pitch described above. When it is longer than the pitch, the same problem as that on the opening 24*a* side may occur.

Further, unlike the present embodiment, in a case where the two ends of the common channel are not closed (see Patent Literature 1 or 2), the same problem as that on the opening 24*a* side in the present embodiment may happen on the two ends. Unlike the present embodiment, when a plurality of second common channels 24 join on the plate 4*f* to configure a manifold channel, even if the length on the end part side of each second common channel 24 is short, the adhesive 81 in the joining portion flows into the third individual channel 16 on the end part side, therefore the same problem of clogging occurs.

The second common channel 24 has an end part on the opening 24*a* side and a closed end part on the opposite side of that. However, between the third individual channel 16 connected to the second common channel 24 at the position closest to the end part on the opening 24*a* side and the third individual channel 16 connected to the second common channel 24 at the position closest to the end part on the opposite side from the opening 24*a*, the former more easily clogs. As the reason for that, there can be mentioned the facts that the distance from the end part is longer in the former channel and that the amount of adhesive 81 which may flow in is larger in the former.

In the second common channel 24, the third individual channels 16 in two ejection unit columns 15*a* are connected at the side surfaces on the two sides. However, in these two ejection unit columns 15*a*, at the third individual channels 16 at the connection positions closest to the end part of the second common channel 24, the third individual channel 16 at the connection position P2 closer to the end part of the second common channel 24 more easily clogs. As the reason for that, there can be mentioned the fact that the connection parts 5*b* are positioned on the end part side except at the third individual channel 16 connected on the endmost part side among the third individual channels 16 in the two ejection unit columns 15*a* and this suppresses the flow of the adhesive 81 from the end part side.

(Configuration for Reducing Possibility of Clogging of Individual Channels)

Figure 13:
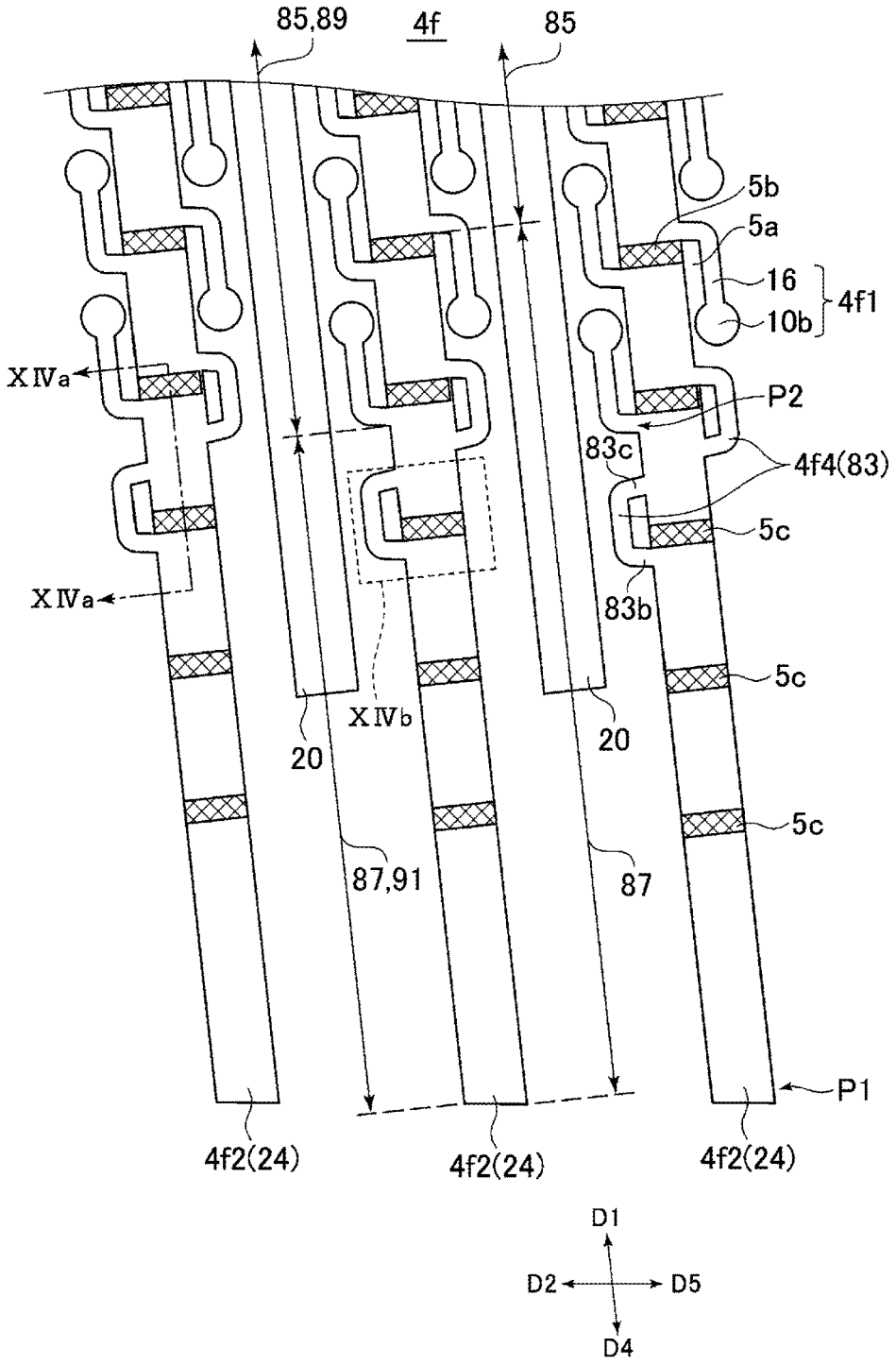
FIG. 13A plan view showing a portion of a plate in which third individual channels are formed.
FIG. 13B is an enlarged diagram of a region XIVb in FIG. 13.
Figure 14A:
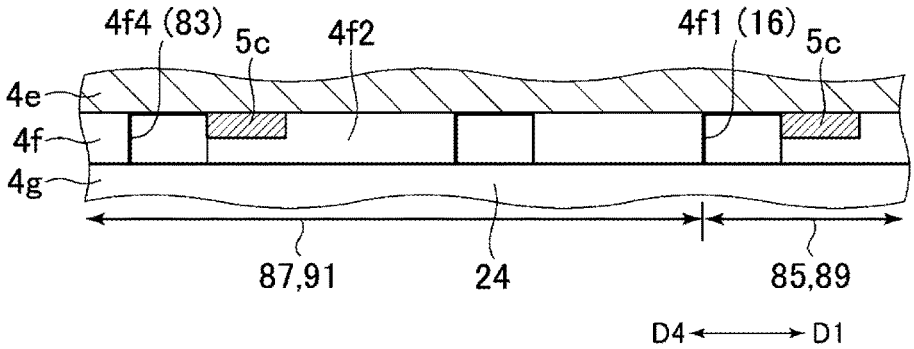
FIG. 14A is a cross-sectional view taken along the XIVa-XIVa line in FIG. 13.

FIG. 13 is a schematic view for explaining the configuration for reducing the possibility of clogging in the third individual channels 16 as described above. Specifically, it is a plan view showing a portion of the plate 4*f*. Further, FIG. 14A is a cross-sectional view taken along the XIVa-XIVa line in FIG. 13. Below, the configuration for reducing the possibility of clogging in the individual channels will be explained mainly concerning the fourth direction D4 side of the second common channel 24. On the first direction D1 side, in the same way as the fourth direction D4 side, the configuration for reducing the possibility of clogging in the individual channel may be provided or may not be provided.

Each of wall surfaces of the second grooves 4*f*2 configuring the second common channels 24, along the second grooves 4*f*2, has a connection region 85 in which the first grooves 4*f*1 configuring the plurality of individual channels 16 are connected and a non-connection region 87 in which the first grooves 4*f*1 are not connected. In the present embodiment, the non-connection region 87, in each wall surface, is the range between the connection position P2 closest to the end part of the second groove 4*f*2 among the connection positions of the plurality of first grooves 4*f*1 with respect to the second groove 4*f*2 and the end part of the second groove 4*f*2 (end part position P1). Further, in the present embodiment, between the wall surface on the left side on the paper surface and the wall surface on the right side on the paper surface, the positions etc. of the connection region 85 and non-connection region 87 are different from each other. In the end part on the fourth direction D4 side, the length of the non-connection region 87 is longer than the pitch of the connection positions of the plurality of first grooves 4*f*1 with respect to the second groove 4*f*2 (distance between the neighboring connection positions) in the connection region 85.

Further, the second groove 4*f*2, along its extending direction, has a connection section 89 in which the first grooves 4*f*1 are connected on at least one of the wall surfaces on the two sides and a non-connection section 91 in which the first grooves 4*f*1 are not connected at any of the wall surfaces on the two sides. In the present embodiment, the non-connection section 91 is the range between the connection position P2 located on the endmost part (end part position P1) side of the second common channel 24 among the connection positions of the plurality of first grooves 4*f*1 with respect to the wall surfaces on the two sides of the second groove 4*f*2 and the end part position P1. Further, in the present embodiment, the non-connection section 91 is substantially the same range as the non-connection region 87 in the wall surface on the left side of the paper surface of the second groove 4*f*2. In FIG. 13 etc., as a matter of convenience, the range of the connection section 89 is indicated by the same arrow as the connection region 85. However, on the first direction D1 side, reverse to the fourth direction D4 side, the connection position of the first groove 4*f*1 on the right side of the paper surface is positioned closer to the end part side than the connection position of the first groove 4*f*1 on the left side of the paper surface, therefore the connection section 89 is different in position and length from the connection regions 85 in all wall surfaces.

In such a configuration, in order to reduce the possibility of clogging of the third individual channels 16, first, the plate 4*f*, for each of the plurality of second common channels 24, has at least one extension part 5*c* the same as the connection part 5*b* in the non-connection section 91 (between the end part position P1 and the connection position P2). Due to the extension part 5*c*, the flow of the adhesive 81 positioned closer to the end part position P1 side than the extension part 5*c* toward the connection position P2 is hindered. Due to this, the inflow of the adhesive 81 to the third individual channel 16 connected to the connection position P2 is suppressed.

Further, second, the plate 4*f*, for each of the second common channels 24, in the non-connection section 91 (between the end part position P1 and the connection position P2), has at least one fourth groove 4*f*4 communicated with the second groove 4*f*2 from the wall surface having the connection position P2 at which the third individual channel 16 is connected (wall surface on left side of paper surface in FIG. 13) between the wall surfaces on the two sides of the second groove 4*f*2. The adhesive 81 positioned closer to the end part position P1 side than the connection position of the fourth groove 4*f*4 with respect to the second common channel 24 flows into the fourth groove 4*f*4 before reaching the connection position P2. Due to this, inflow of the adhesive 81 to the third individual channel 16 connected to the connection position P2 is suppressed.

(Details of Extension Part)

The configuration of the extension part 5*c* is the same as the connection part 5*b* for reinforcing the partition wall 5*a* explained with reference to FIG. 10 except its position. That is, the extension part 5*c* is connected to the wall surfaces on the two sides of the second groove 4*f*2 (second common channel 24). Further, for example, it is formed by half etching from the lower surface side (ejection hole 8 side).

Note that, the extension part 5*c*, unlike the connection part 5*b*, does not contribute to reinforcement of the partition wall 5*a*. Therefore, it is not inherently necessary. The thickness of the extension part 5*c* and its size in the channel direction may be suitably set. Further, they may be the same as or different from the thickness of the connection part 5*b* and its size in the channel direction. The connection part 5*b* need not be provided. That is, only the extension part 5*c* may be provided.

Concerning the adhesive 81, in more detail, for example, the possibility of flow into the third individual channel 16 is reduced by being blocked by the extension part 5*c*. Further, for example, when flowing down the edge portion formed by the upper surface and the wall surface of the second common channel 24 and reaching the extension part 5*c*, the adhesive 81 flows along the extension part 5*c* so as to transverse the second common channel 24 due to the capillary force of the edge portion formed by the upper surface of the second common channel 24 and the surface on the end part position P1 side of the extension part 5*c*. Due to this as well, flow of the adhesive 81 into the third individual channel 16 is suppressed. Further, the edge portion (edge portion formed by the upper surface of the second common channel 24 and the surface on the connection position P2 side of the extension part 5*c*) on inverse side to the above edge portion also attracts the adhesive 81 due to its capillary force, therefore it may contribute to suppression of flow of the adhesive 81 into the third individual channel 16.

At least one extension part 5*c* only have to be provided in the non-connection section 91. Even by one extension part 5*c*, the amount of adhesive 81 reaching the connection position P2 is reduced to a certain extent. Consequently the possibility of clogging of the third individual channel 16 at the connection position P2 is reduced.

FIG. 13 exemplifies a case where a plurality of (three) extension parts 5*c* are provided in the channel direction of the second common channel 24 at mutual intervals. When the plurality of extension parts 5*c* are arranged in this way, for example, the flow of the amount of adhesive 81 difficult to block by one extension part 5*c* can be blocked. Note that, the interval of the plurality of extension parts 5*c* may be suitably set. FIG. 13 exemplifies the case where the pitch of the extension parts 5*c* is substantially the same as the pitch of the connection parts 5*b* (pitch of the first grooves 4*f*1).

The position of the extension part 5*c* may be a suitable position in the non-connection section 91. No matter what the position in the non-connection section 91 it is positioned at, the amount of the adhesive 81 arriving at the connection position P2 can be reduced to a certain extent. Consequently the possibility of clogging in the third individual channel 16 at the connection position P2 can be reduced.

For example, an extension part 5*c* with a distance from the connection position P2 of not more than the pitch of the connection positions of the plurality of third individual channels 16 with respect to the second common channel 24 is provided. In this case, the amount of the adhesive 81 located between the connection position P2 and the extension part 5*c* becomes the same as the amount of the adhesive 81 located among the plurality of connection positions or less, therefore the possibility that only the third individual channel 16 on the endmost part side clogs is reduced. Note that, the "distance" referred to here means for example the distance in the direction parallel to the channel direction of the second common channel 24 and may be the distance between the edge part on the extension part 5*c* side of the first groove 4*f*1 and the edge part on the first groove 4*f*1 side of the extension part 5*c*.

Note that, in the above description, the connection part 5*b* and the extension part 5*c* were differentiated according to whether they are positioned within the non-connection section 91 defined paying attention to the wall surfaces on the two sides of the second groove 4*f*2. However, the connection part 5*b* and the extension part 5*c* may be differentiated according to whether they are positioned within the non-connection region 87 defined paying attention to only one wall surface as well. From another viewpoint, when paying attention to the wall surface on the right side of the paper surface in FIG. 13 between the wall surfaces on the two sides of the second groove 4*f*2, the connection part 5*b* located just above the connection position P2 (the fourth connection part 5*b* from the bottom of the paper surface) may be grasped as the extension part 5*c* for the wall surface on the right side of the paper surface as well. This extension part 5*c* (acting also as the connection part 5*b*) can contribute to reduction of the possibility of clogging in the first groove 4*f*1 on the endmost part side which is connected to the wall surface on the right side of the paper surface.

(Details of Dummy Channels)

A dummy channel 83 is for example configured by a fourth groove 4*f*4 as a whole. That is, the plates 4*e* and 4*g* above and below the plate 4*f* close the top and the bottom of the fourth groove 4*f*4 throughout the fourth groove 4*f*4. Accordingly, the shape of the dummy channel 83 is the same as the shape of the fourth groove 4*f*4 shown in FIG. 13. The shape, width, and length of the dummy channel 83 may be suitably set.

In the non-connection section 91, at least one fourth groove 4*f*4 (dummy channel 83) only have to be provided with respect to one wall surface (for example the wall surface to which the first groove 4*f*1 is connected at the connection position P2) of the second groove 4*f*2 (second common channel 24) to which a plurality of first grooves 4*f*1 (third individual channels 16) are connected. Even by one fourth groove 4*f*4 being provided on one wall surface, the amount of the adhesive 81 flowing down this one wall surface and arriving at the connection position P2 is reduced to a certain extent. Consequently the possibility of clogging in the third individual channel 16 at the connection position P2 is reduced. Note that, although not particularly shown, in the same way as the extension part 5*c*, a plurality of fourth grooves 4*f*4 may be provided on one wall surface at intervals in the channel direction of the second common channel 24.

Further, a fourth groove 4*f*4 may be provided not only on the wall surface of the second common channel 24 to which a third individual channel 16 is connected at the connection position P2, but also on the wall surface on the opposite side (right side of the paper surface in FIG. 13). That is, a fourth groove 4*f*4 may be provided on each of the wall surfaces on the two sides of the second common channel 24 as well. In this case, in the fourth groove 4*f*4 connected to the wall surface on the right side of the paper surface, one end only have to be connected to the second groove 4*f*2 in the non-connection region 87 of the wall surface on the right side of the paper surface and does not always have to be connected to the second groove 4*f*2 in the non-connection section 91. From another viewpoint, in the same way as the above extension part 5*c*, paying attention to only one wall surface, it may be judged whether the fourth groove 4*f*4 is one connected closer to the end part position P1 side than the connection position closest to the end part among the connection positions of the plurality of first grooves 4*f*1 with respect to the second groove 4*f*2. Note that, FIG. 13 exemplifies the case where also the fourth groove 4*f*4 connected to the wall surface on the right side of the paper surface is positioned in one end between the connection position P2 and the end part position P1.

The dummy channel 83 is for example communicated at the two ends with the second common channel 24. From another viewpoint, the dummy channel 83 bypasses the second common channel 24. Specifically, for example, the two ends of the fourth groove 4f4 configuring the dummy channel 83 are connected to one wall surface of the second groove 4f2 configuring the second common channel 24. That is, the first end 83*b* of the dummy channel 83 is connected to one wall surface of the second groove 4f2 in the non-connection region 87, and the second end 83*c* of the dummy channel 83 is connected to the connection position P2 side (connection region 85 side) relative to the first end 83*b* on one wall surface of the second groove 4f2 in the non-connection region 87 or connection region 85 (the former in the present embodiment).

Note that, there are other aspects besides the aspect where the two ends are connected to one wall surface. For example, unlike the present embodiment, in a case where the dummy channel 83 is configured by including not only a hole of the plate 4*f*, but also a hole of a plate other than the plate 4*f*, either of the two ends of the dummy channel 83 may be connected at the position of the inner surface of the second common channel 24 which is separated from the one wall surface described above (for example a region on the center side of the upper surface, lower surface, or the wall surface on the opposite side) as well.

By connecting the two ends of the dummy channel 83 to the second common channel 24 in this way, for example, the dummy channel 83 does not form a dead end so long as the adhesive 81 does not clog it. Accordingly, when the liquid ejection head 2 is used, the liquid circulates even in the dummy channel 83, therefore pooling of the liquid is suppressed.

Figure 14B:
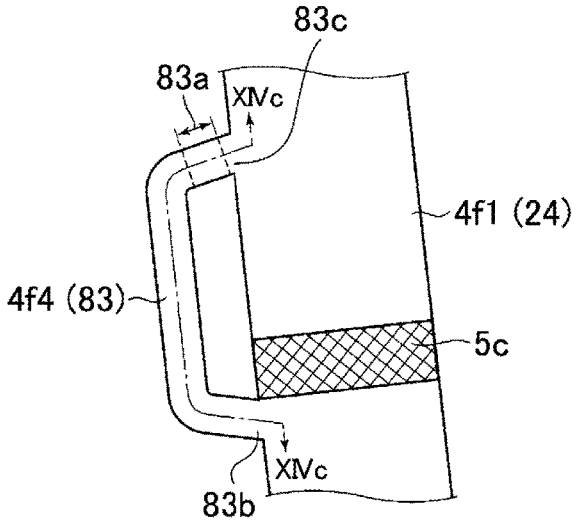
FIG. 14C is a cross-sectional view taken along the XIVc-XIVc line in FIG. 14B.
Figure 14C:
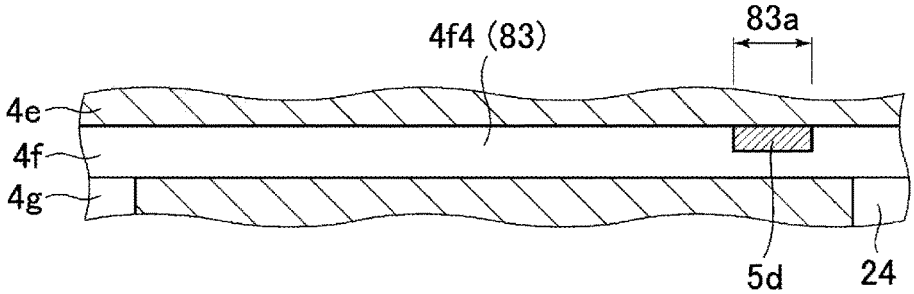

FIG. 14B is an enlarged diagram of the region XIVb in FIG. 13. FIG. 14C is a cross-sectional view taken along the XIVc-XIVc line in FIG. 14B.

As shown in these figures, a dummy channel 83 may be provided with a small cross-section part 83*a* having a smaller cross-sectional area than the other portion in the dummy channel 83. The adhesive 81 flowing into the dummy channel 83 is for example dammed up by the small cross-section part 83*a* and/or trapped by the capillary force in the small cross-section part 83*a*. Accordingly, flow of the adhesive 81 which had flowed into the dummy channel 83 to the outside of the dummy channel 83 (inside of the second common channel 24) is suppressed, and consequently the possibility of clogging in the third individual channel 16 is reduced.

The small cross-section part 83*a* is configured by one or both of the width and thickness of part of the dummy channel 83 being reduced. In the present embodiment, the small cross-section part 83*a* is configured by reduction of the thickness of part of the dummy channel 83. The small cross-section part 83*a* having a thickness smaller than that of the other parts in this way is for example configured by formation of a beam 5*d* connecting the wall surfaces of the fourth groove 4f4 to each other by half etching of the plate 4*f*. Note that, the change of the cross-sectional area may be stepwise (change forming steps on the inner surface of the dummy channel 83) as exemplified in FIG. 14C or may be a gradual change.

The small cross-section part 83*a* is positioned on the side closer to the second end 83*c* than the center position in the channel direction of the dummy channel 83. In other words, the small cross-section part 83*a* is positioned on the downstream side from the center position in the channel direction of the dummy channel 83. Note that, the "downstream side" referred to here means the downstream side of the adhesive 81 which flows into the dummy channel 83 instead of the third individual channel 16 on the side closest to the end part position P1 and is not the downstream side of the liquid (ink etc.) at the time of use of the liquid ejection heads 2.

For example, as in the illustrated example, when the two ends of the dummy channel 83 are communicated with the second common channel 24 from one wall surface of the second groove 4f2 (wall surface on the left side of the paper surface in FIG. 14B), between the two ends of the dummy channel 83, relative to one end part, the side of the other end part positioned closer to the connection position P2 is the downstream side. Further, for example, when one end of the dummy channel 83 is communicated with the second common channel 24 from one wall surface of the second groove 4f2 and the other end is communicated with the second common channel 24 from a position separated from the one wall surface described before (for example the wall surface on the opposite side of the second common channel 24, the region on the center side of the upper surface, the lower surface or the region on the lower surface side of the wall surface), the other end is the end part on the downstream side.

In this way, by positioning the small cross-section part 83*a* on the downstream side of the dummy channel 83 in the flow of the adhesive 81, for example, compared with a case where the small cross-section part 83*a* is positioned on the upstream side of the dummy channel 83 (this case is also included in the technique according to the present disclosure), a larger amount of adhesive 81 is more easily made to flow into the dummy channel 83.

Note that, the explanation was given for provision of the small cross-section part 83*a* for the dummy channel 83 on the wall surface (wall surface on the left side of the paper surface) of the second groove 4f2 (second common channel 24) to which the first groove 4f1 (third individual channel 16) is connected at the connection position P2. However, the small cross-section part 83*a* may be provided also for the dummy channel 83 on the wall surface on the opposite side (right side of the paper surface in FIG. 13) as well. The position, shape, size, etc. of the small cross-section part 83*a* in this case may be the same as those described above as well.

(Combination of Extension Part and Dummy Channel)

Both of the extension part 5*c* and the dummy channel 83 do not have to be provided. Either may be provided as well. However, by providing both, the possibility of clogging in the third individual channel 16 is effectively reduced.

In particular, in the case where one end of the fourth groove 4f4 (dummy channel 83) is adjacent to the end part position P1 side (opposite side from the connection region 85) relative to the extension part 5*c*, the adhesive 81 prevented from flowing to the connection position P2 by the extension part 5*c* flows into the dummy channel 83, therefore the effect of suppression of flow of the adhesive 81 into the third individual channel 16 synergistically increases. Note that, when the two ends of the fourth groove 4f4 are communicated with the second groove 4f2 (second common channel 24), the end of the fourth groove 4f4 which is adjacent to the extension part 5*c* is for example the end part on the end part position P1 side. The term "adjacent" referred to here for example includes not only a case where the extension part 5*c* and the dummy channel 83 are adjacent to each other in the channel direction of the second common channel 24 without a gap, but also a case where they are separated from each other by a relatively minute distance (for example not more than 2 times the error in etching).

The extension part 5*c*, as already explained, does not contribute to reinforcement of the partition wall 5*a* and originally is not unnecessary. However, in a case where a dummy channel 83 is provided and the two ends of the fourth groove 4*f*4 configuring the dummy channel 83 are connected to the second groove 4*f*2, an island-shaped portion is formed, therefore it contributes to easier handling of the island-shaped portion.

(Modifications)

Figure 15A:
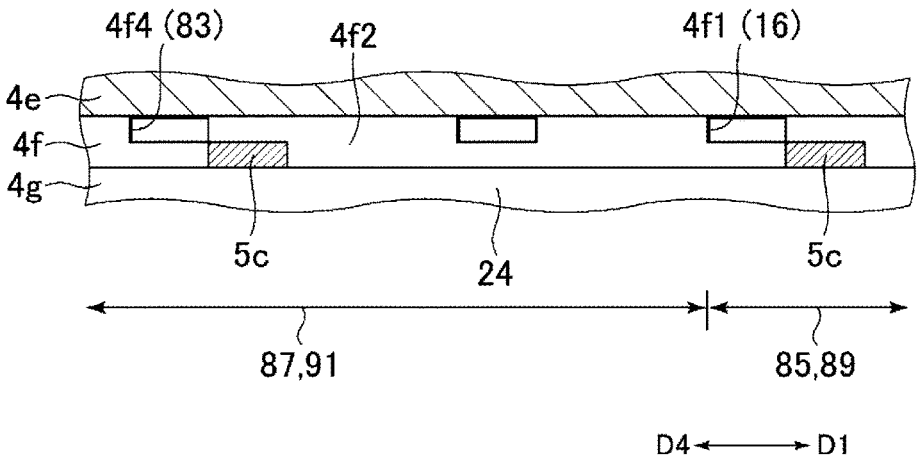
FIG. 15A and FIG. 15B are cross-sectional views corresponding to FIG. 14A and FIG. 14C according to modifications.
Figure 15B:
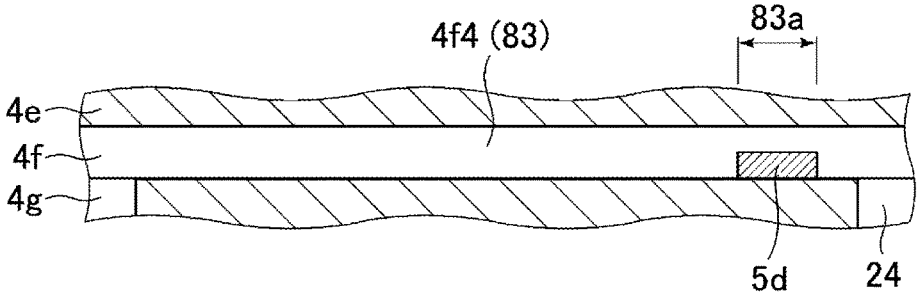

FIG. 15A and FIG. 15B are cross-sectional views corresponding to FIG. 14A and FIG. 14C according to modifications. Note that, in the following description, basically only parts different from the above embodiments will be explained. The points which are not particularly referred to are the same as the above embodiments.

In the modification in FIG. 15A, the first groove 4*f*1 (third individual channel 16) and fourth groove 4*f*4 (dummy channel 83) are formed by half etching of the plate 4*f*. The half etching is for example carried out with respect to the top surface side of the plate 4*f*. In this modification as well, the upper surfaces of the third individual channel 16 and dummy channel 83 are flush with respect to the upper surface of the second common channel 24.

Even in such a configuration, in the third individual channel 16, the problem arises that the adhesive 81 easily causes clogging. Further, by guiding the adhesive 81 into the dummy channel 83, the possibility of clogging in the third individual channel 16 can be reduced.

Further, in the modification in FIG. 15A, the extension part 5*c* is formed not by half etching from the bottom surface side of the plate 4*f*, but by half etching from the top surface side of the plate 4*f*. Accordingly, the upper surface of the extension part 5*c* becomes lower than the upper surface of the second common channel 24, therefore a relatively small gap is generated between the two.

Accordingly, the extension part 5*c* in the modification traps the adhesive 81 due to the capillary force generated between it and the upper surface of the second common channel 24. Due to this, the possibility of flow of the adhesive 81 into the third individual channel 16 is reduced. Even in a case where the amount of the adhesive 81 is relatively large, the adhesive 81 spreads along the extension part 5*c* to transverse the second common channel 24 due to the capillary force and hardly reaches the third individual channel 16 beyond the extension part 5*c*. The amount of the adhesive 81 trapped can be made larger by for example making the area of the extension part 5*c* when viewed on a plane larger. Accordingly, it is possible to trap a larger amount of adhesive 81 than that by the extension part 5*c* in the embodiment.

Further, in the modification in FIG. 15B, the beam 5*d* configuring the small cross-section part 83*a* is formed not by half etching from the bottom surface side of the plate 4*f*, but by half etching from the top surface side of the plate 4*f*. This beam 5*d* trap the adhesive 81 due to the capillary force generated with the upper surface of the dummy channel 83.

Note that, in the above embodiments and modifications, the plate 4*f* is one example of the first plate, the plate 4*e* is one example of the second plate, the second common channel 24 is one example of the common channel, the third individual channel 16 is one example of the individual channel, the second groove 4*f*2 is one example of the common channel-use groove, the first groove 4*f*1 is one example of the individual channel-use groove, and the fourth groove 4*f*4 is one example of the dummy channel-use groove.

Figure 16A:
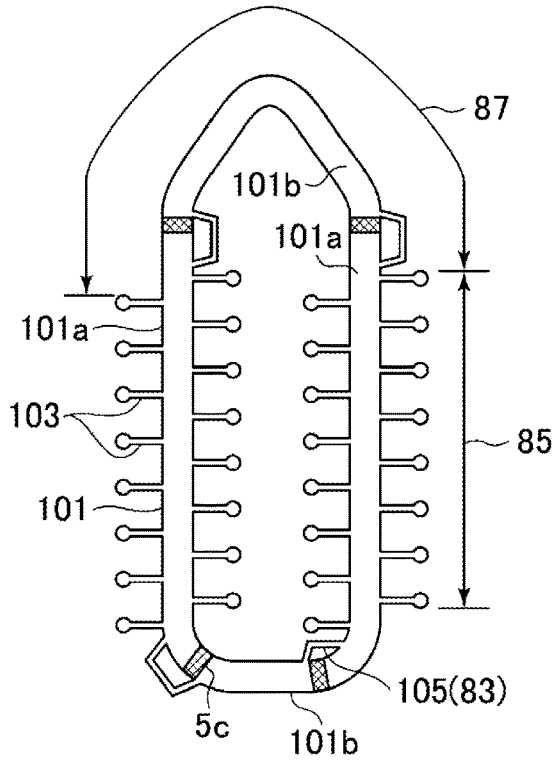
FIG. 16A and FIG. 16B are plan views schematically showing channels according to the modifications.
Figure 16B:
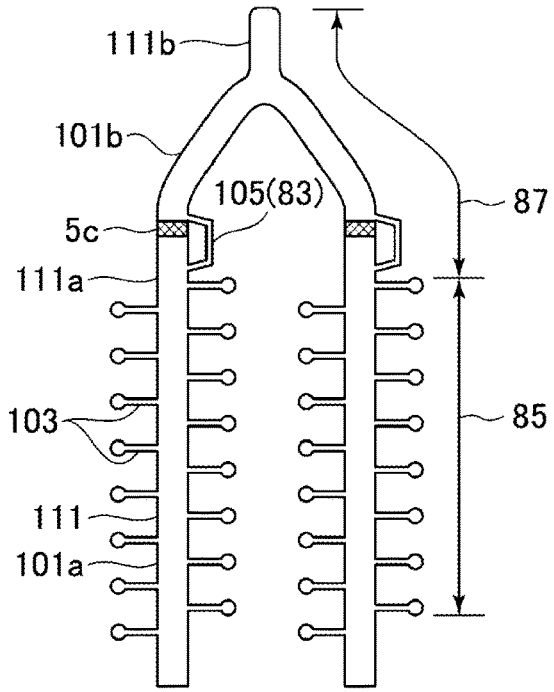

FIG. 16A and FIG. 16B are plan views respectively substantially showing modifications of the second common channel 24 (second groove 4*f*2) and third individual channel 16 (first groove 4*f*1) etc. That is, they are plan views showing modifications of the first plate (plate 4*f* in the embodiments).

In the modification shown in FIG. 16A, a common channel-use groove 101 corresponding to the second groove 4*f*2 in the embodiments is formed as a groove extending in an annular shape. More specifically, for example, the common channel-use groove 101 has a plurality of (two in the shown example) main grooves 101*a* which extend in parallel and a communication groove 101*b* connecting the end parts of the main grooves 101 to each other. The main grooves 101*a* for example linearly extend, while the communication groove 101*b* for example extends so as to be curved. The individual channel-use grooves 103 corresponding to the first grooves 4*f*1 in the embodiments are connected to the wall surfaces of the main grooves 101*a*. In other words, the individual channel-use grooves 103 are not connected to the communication groove 101*b*.

Even with respect to such a common channel-use groove 101 and individual channel-use grooves 103, the configurations for reducing the possibility of clogging in the individual channel-use grooves 103 as explained in the present embodiments may be applied. For example, each wall surface of the common channel-use groove 101 has a connection region 85 in which a plurality of individual channel-use grooves 103 are connected and a non-connection region 87 in which the plurality of individual channel-use grooves 103 are not connected and which is longer than the pitch of the connection positions of the plurality of individual channel-use grooves 103 with respect to the common channel-use groove 101 in the connection region 85. Note that, in FIG. 16A, notations are assigned only for one pair of the connection regions 85 and non-connection regions 87 which are adjacent to each other. The non-connection region 87 is provided with an extension part 5*c* and a dummy channel 83 (dummy channel-use groove 105 corresponding to the fourth groove 4*f*4).

Note that, it may also be interpreted that one common channel-use groove is configured by one main groove 101*a* and part or all of one or two communication grooves 101*b* connected to this.

In the modification shown in FIG. 16B, the common channel-use groove 111 corresponding to the second groove 4*f*2 in the embodiment is formed as a manifold-shaped groove. More specifically, for example, the common channel-use groove 111 has a plurality of (two in the shown example) branched grooves 111*a* which extend in parallel and a header groove 111*b* formed by the branched grooves 111*a* joined together. Each branched groove 111*a* for example has a shape including the main grooves 101*a* in FIG. 16A and a portion of the communication groove 101*b* in FIG. 16A. The header groove 111*b* is for example broader than the branched grooves 111*a* and extends outward. The individual channel-use grooves 103 corresponding to the first grooves 4*f*1 in the embodiment are the same as those in FIG. 16A.

Even with respect to such a common channel-use groove 111 and individual channel-use grooves 113, the configurations for reducing the possibility of clogging in the individual channel-use grooves 103 explained in the embodiments may be applied. For example, each wall surface of the common channel-use groove 111 has a connection region 85 in which the plurality of individual channel-use grooves 103 are connected and a non-connection region 87 in which the plurality of individual channel-use grooves 103 are not connected and which is longer than the pitch of the connection positions of the plurality of individual channel-use grooves 103 with respect to the common channel-use groove 111 in the connection region 85. Note that, in FIG. 16B, notations are assigned only for one pair of the connection regions 85 and non-connection regions 87 which are adjacent to each other. Further, the non-connection region 87 is provided with an extension part 5*c* and a dummy channel 83 (dummy channel-use groove 105 corresponding to the fourth groove 4*f*4).

In the modification in FIG. 16B, the non-connection region 87 may be defined in the communication groove 101*b* in the same way as FIG. 16A by ignoring the header groove 111*b* as well. In this case, in the same way as FIG. 16A, the two branched grooves 111*a* may be grasped as one common channel-use groove, and one branched groove 111*a* may be grasped as one common channel-use groove. Further, in the modification in FIG. 16B, in the lower part of the paper surface, when the distance from the individual channel-use groove 103 to the end part of the common channel-use groove 111 is long, the non-connection region 87 may be defined on the end part side in the same way as the embodiments.

Other than what is described above, although not particularly shown, the common channel-use groove and individual channel-use grooves may be given various shapes. For example, the header groove 111*b* may be provided in the modification in FIG. 16A or the header groove 111*b* may be omitted in the modification in FIG. 16B.

The technique according to the present disclosure is not limited to the above embodiments or modifications. Various changes are possible so far as not out of the gist of the disclosure.

The method for manufacturing the liquid ejection head and recording device need not necessarily be one having a possibility of clogging of an adhesive. Even if there is no possibility of clogging of the adhesive, for example, the extension part 5*c* contributes to suppression of formation of a standing wave on the end part side of the second common channel 24 by reflecting or dispersing the pressure wave on the end part side of the second common channel 24. The same is true also for the dummy channel 83.

For example, as a pressurizing part, the example of pressurizing a pressurizing chamber 10 by piezoelectric deformation of a piezoelectric actuator was shown. However, the present disclosure is not limited to this. For example, it is possible to provide a heat generation part for each of the pressurizing chambers 10 and form a pressurizing part heating the liquid inside the pressurizing chamber 10 by the heat of the heat generation part to pressurize the liquid by thermal expansion.

An individual channel-use groove (first groove 4*f*1) may be configured by half etching of the bottom surface side of the plate 4*f* as well. From another viewpoint, the upper surface of a third individual channel 16 need not be flush with respect to the upper surface of a second common channel 24. Even in this case, the third individual channel 16 is communicated with the second common channel 24 in the plate 4*f* which is superposed on the bottom surface of the plate 4*e* configuring the upper surface of the second common channel 24. Therefore, compared with a case where the first groove 4*f*1 is formed in another plate, the adhesive 81 easily flows into the third individual channel 16. Further, the third individual channel 16 may be configured by including the groove of a plate other than the plate 4*f* as well. For example, a recessed groove or through groove which is superposed on the first groove 4*f*1 may be formed in the plate 4*e* or 4*g* as well.

The extension part 5*c* is not limited to one configured over the wall surfaces on the two sides of the common channel-use groove (second groove 4*f*2) and may be one which extends outward from one wall surface, but does not reach the other wall surface. Further, the extension part 5*c* may be one configured using the entire thickness of the plate 4*f* or may be one which is formed by half etching of the plate 4*f* from the two sides and is provided on the center side in the thickness direction of the plate 4*f*. Any of the combinations of the three aspects of the first groove 4*f*1 of the through groove, recessed groove on the top surface side, and recessed groove on the bottom surface side and the four aspects of the extension part 5*c* of the entire thickness, the thickness of only the bottom surface side, the thickness of only the top surface side, and the thickness on the center side (3×4=12 aspects) may be employed. Further, the half etching for the first groove 4*f*1 and the half etching for the extension part 5*c* need not be carried out to the same thickness.

The dummy channel 83 only have to be connected to the ejection unit 15. Accordingly, for example, the dummy channel 83 may extend from the second common channel 24 and be a dead end, may be connected to the dummy ejection unit 17, or may be connected to the first common channel 20. The dummy channel-use groove (fourth groove 4*f*4) may be configured by half etching of the bottom surface side of the plate 4*f* as well. From another viewpoint, the upper surface of the dummy channel 83 need not be flush with respect to the upper surface of the second common channel 24 either. Even in this case, compared with the case where the fourth groove 4*f*4 is formed in another plate, the adhesive 81 easily flows into the dummy channel 83.

The plate 4*e* configuring the upper surfaces of the second common channels 24 may be half-etched in the bottom surface to configure the upper parts of the second common channels 24. Further, the plate 4*e* may be half etched at the bottom surface or usually etched to configure parts of the third individual channels 16 and/or dummy channels 83 at the upper surface sides.

The third individual channels in the embodiment may not only be used for recovery of the liquid, but also for supply of the liquid. That is, the individual channels formed by the grooves in the first plate (4*f*) may be used for supply or for recovery. Further, the channel member may be also one having only individual channels for supplying the liquid and not having individual channels for recovery.

The adhesive is not limited to a thermosetting resin. This is because so far as the adhesive has fluidity before solidification, there is a possibility of clogging of the adhesive in the individual channels. Accordingly, the adhesive may be one hardened at a normal temperature as well.

REFERENCE SIGNS LIST

1 . . . color inkjet printer
2 . . . liquid ejection head
2*a* . . . head body
4 . . . first channel member
4*a* to 4*m* . . . plates
4-1 . . . pressurizing chamber surface
4-2 . . . ejection hole surface
4*f*1 . . . first groove (individual channel-use groove)
4*f*2 . . . second groove (common channel-use groove)

4f4 . . . fourth groove (dummy channel-use groove)
5*c* . . . extension part
6 . . . second channel member
6*a* . . . through hole
6*b*, 6*c* . . . openings
8 . . . ejection hole
8*a* . . . ejection hole column
8*b* . . . ejection hole row
10 . . . pressurizing chamber
10*a* . . . pressurizing chamber body
10*b* . . . partial channel
10*c* . . . pressurizing chamber column
10*d* . . . pressurizing chamber row
11 . . . dummy pressurizing chamber
12 . . . first individual channel
14 . . . second individual channel
15 . . . ejection unit
16 . . . third individual channel (individual channel)
20 . . . first common channel (common channel)
20*a* . . . opening
22 . . . first integrating channel
22*a* . . . opening
24 . . . second common channel
24*a* . . . opening
26 . . . second integrating channel
26*a* . . . opening
28 . . . end part channel
28*a* . . . broad-width portion
28*b* . . . narrowed portion
28*c*, 28*d* . . . openings
30 . . . damper
30*a* . . . first damper
30*b* . . . second damper
32 . . . damper chamber
32*a* . . . first damper chamber
32*b* . . . second damper chamber
40 . . . piezoelectric actuator substrate
40*a*, 40*b* . . . piezoelectric ceramic layers
42 . . . common electrode
44 . . . individual electrode
44*a* . . . individual electrode body
44*b* . . . extraction electrode
46 . . . connection electrode
48 . . . displacement element
50 . . . housing
50*a*, 50*b*, 50*c* . . . openings
50*d* . . . heat insulation part
52 . . . heat radiation plate
54 . . . circuit board
56 . . . pressing member
58 . . . elastic member
60 . . . signal transmission part
62 . . . driver IC
70 . . . head mounting frame
72 . . . head group
74*a*, 74*b*, 74*c*, 74*d* . . . conveying rollers
76 . . . control part
83 . . . dummy channel
83*a* . . . small cross-section part
83*b* . . . first end
83*c* . . . second end
85 . . . connection region
87 . . . non-connection region
89 . . . connection section
91 . . . non-connection section
P . . . recording medium
D1 . . . first direction
D2 . . . second direction
D3 . . . third direction
D4 . . . fourth direction
D5 . . . fifth direction
D6 . . . sixth direction
P1 . . . end part position
P2 . . . connection position

The invention claimed is:

1. A liquid ejection head comprising:

a channel member formed from a plurality of vertically stacked plates that include a first plate and a second plate;

a common channel formed from holes in the plurality of vertically stacked plates, wherein the second plate is bonded by an adhesive to a top surface of the first plate and configures an upper surface of the common channel;

a plurality of ejection units connected to the common channel, wherein each of the plurality of ejection units includes:

an ejection hole, a pressurizing chamber connected to the ejection hole, and an individual channel connected to the pressurizing chamber and to the common channel; and a plurality of pressurizing parts individually pressurizing the plurality of pressurizing chambers, wherein the first plate includes:

a common channel-use groove configuring the common channel, and a plurality of individual channel-use grooves which are communicated with the common channel-use groove from one wall surface between wall surfaces on two sides of the common channel-use groove and individually configure each respective individual channel, and wherein the one wall surface of the common channel-use groove includes:

a connection region in which the plurality of individual channel-use grooves are connected, and a non-connection region which is adjacent to the connection region, to which the plurality of individual channel-use grooves are not connected, and which is longer than a distance between each two adjacent connection positions among connection positions of the plurality of individual channel-use grooves with respect to the one wall surface in the connection region, and wherein the first plate further comprises at least one extension part which extends outward from the one wall surface in the non-connection region.

2. The liquid ejection head according to claim 1, wherein the common channel-use groove is shaped to comprise two ends, and the non-connection region is a range between a connection position closest to one end of the common channel-use groove among the connection positions of the plurality of individual channel-use grooves with respect to the one wall surface and the one end.

3. The liquid ejection head according to claim 1, wherein the at least one extension part is connected to respective wall surfaces on the two sides of the common channel-use groove.

4. The liquid ejection head according to claim 1, wherein the upper surface of the common channel and an upper surfaces of each respective individual channel are flush.

5. The liquid ejection head according to claim 1,
wherein an upper surface of the at least one extension part is lower than the upper surface of the common channel.

6. The liquid ejection head according to claim 1, wherein:
the first plate further comprises a second plurality of individual channel-use grooves which are communicated with the common channel-use groove from an other wall surface of the common channel-use groove and individually configure the plurality of individual channels,
the common channel-use groove includes
a connection section in which the plurality of individual channel-use grooves are connected on at least one side between respective wall surfaces on the two sides of the common channel-use groove, and
a non-connection section which is adjacent to the connection section, in which the plurality of individual channel-use grooves are not connected to any of the respective wall surfaces on the two sides of the common channel-use groove, and which is longer than the distance between each two neighboring connection positions among the connection positions of the plurality of individual channel-use grooves with respect to the one wall surface in the connection region, and
the extension part is located in the non-connection section.

7. The liquid ejection head according to claim 1,
wherein that at least one extension part comprises a plurality of extension parts formed at intervals in a channel direction of the common channel.

8. The liquid ejection head according to claim 1,
wherein a distance between the extension part closest to the connection region and a connection position closest to the non-connection region among the connection positions of the plurality of individual channel-use grooves with respect to the one wall surface is not more than a pitch of the connection positions of the plurality of individual channel-use grooves with respect to the one wall surface in the connection region.

9. The liquid ejection head according to claim 1,
wherein the first plate comprises at least one dummy channel-use groove which is communicated with the common channel-use groove from the one wall surface in the non-connection region, the dummy channel-use groove configuring a dummy channel which is not connected to the plurality of ejection units.

10. The liquid ejection head according to claim 9, wherein a position of communication of the dummy channel-use groove with the common channel-use groove is adjacent to the extension part on an opposite side from the connection region.

11. The liquid ejection head according to claim 9,
wherein two ends of the dummy channel are communicated with the common channel.

12. The liquid ejection head according to claim 9,
wherein a distance between a connection position of a particular at least one dummy channel that is closest to the connection region among connection positions with respect to the common channel-use groove in the non-connection region and a connection position closest to the non-connection region among respective connection positions of the plurality of individual channel-use grooves with respect to the one wall surface is not more than a pitch of the respective connection positions of the plurality of individual channel-use grooves with respect to the one wall surface in the connection region.

13. The liquid ejection head according to claim 1,
wherein the plurality of vertically stacked plates are stacked through an adhesive that is applied also in a region configuring the upper surface of the common channel in a bottom surface of the second plate.

14. A recording device comprising:
the liquid ejection head disclosed in claim 1,
a conveying part conveying a recording medium with respect to the liquid ejection head, and
a control part controlling the liquid ejection head.

15. A method manufacturing the liquid ejection head disclosed in claim 1, comprising:
a step of applying the adhesive to an entirety of a bottom surface of the second plate, and
a step of superposing the bottom surface of the second plate on which the adhesive is applied on the top surface of the first plate.

16. A liquid ejection head comprising:
a channel member formed from a a plurality of vertically stacked plates that include a first plate a second plate;
a common channel formed from holes in the plurality of vertically stacked plates, wherein the second plate is bonded by an adhesive to a top surface of the first plate and configures an upper surface of the common channel;
a plurality of ejection units connected to the common channel, wherein each of the plurality of ejection units includes:
an ejection hole,
a pressurizing chamber connected to the ejection hole, and
an individual channel connected to the pressurizing chamber and to the common channel; and
a plurality of pressurizing parts individually pressurizing the plurality of pressurizing chambers,
wherein the first plate includes:
a common channel-use groove configuring the common channel,
a plurality of individual channel-use grooves which are communicated with the common channel-use groove from one wall surface between wall surfaces on two sides of the common channel-use groove and individually configure respective individual channels, and
at least one dummy channel-use groove that configures a dummy channel which is not connected to the plurality of ejection units:
wherein the one wall surface of the common channel-use groove includes:
a connection region in which the plurality of individual channel-use grooves are connected, and
a non-connection region which is adjacent to the connection region, in which the plurality of individual channel-use grooves are not connected, and which is longer than a distance between each two adjacent connection positions among connection positions of the plurality of individual channel-use grooves with respect to the one wall surface in the connection region, wherein the at least one dummy channel-use groove communicates with the common channel-use groove from the one wall surface in the non-connection region.

17. The liquid ejection head according to claim 16, wherein the dummy channel comprises a small cross-section part having a smaller cross-sectional area than other parts in the dummy channel.

18. The liquid ejection head according to claim 17, wherein:

when one end between two ends of the dummy channel which is connected to the one wall surface in the non-connection region is defined as a first end, and a second end which is connected to the one wall surface on a connection region side with respect to the first end or the second end which is connected to a position of the common channel separate from the one wall surface is defined as the second end, and the small cross-section part is located closer to a side of the second end than a center position in a channel direction of the dummy channel.

19. A liquid ejection head comprising:

a first plate that includes:

a common channel-use groove, comprising first and second side surfaces facing to each other, and a plurality of individual channel-use grooves which are communicated with the common channel-use groove and connected to the first side surface;

a channel member formed from the first plate, a second plate and an adhesive that is sandwiched by the first and second plate in a vertical direction, wherein the adhesive bonds a top surface of the first plate to the second plate; and a pressurizing part disposed on the channel member;

wherein the first side surface includes:

a connection region in which the plurality of individual channel-use grooves are connected to the common channel-use groove; and a non-connection region which is next to the connection region, in which the plurality of individual channel-use grooves are not connected to the common channel-use groove, wherein at least one adhesive stopper is disposed on the first side surface in the non-connection region.

20. The liquid ejection head according to claim 19, wherein a distance between the adhesive stopper and the connection region is longer than a distance between each two adjacent connection positions wherein the plurality of individual channel-use grooves each connect to the common channel-use groove at one respective connection portion in the connection region.

* * * * *